US011319189B2

(12) United States Patent
Sato et al.

(10) Patent No.: US 11,319,189 B2
(45) Date of Patent: May 3, 2022

(54) ELEVATOR

(71) Applicant: FUJITEC CO., LTD., Shiga (JP)

(72) Inventors: Koichi Sato, Shiga (JP); Junichi Nakagawa, Shiga (JP); Yuji Morooka, Shiga (JP); Yusuke Ono, Shiga (JP)

(73) Assignee: FUJITEC CO., LTD., Shiga (JP)

( * ) Notice: Subject to any disclaimer, the term of this patent is extended or adjusted under 35 U.S.C. 154(b) by 0 days.

(21) Appl. No.: 17/072,235

(22) Filed: Oct. 16, 2020

(65) Prior Publication Data

US 2021/0155456 A1 May 27, 2021

(30) Foreign Application Priority Data

Nov. 25, 2019 (JP) ..... JP2019-212642

(51) Int. Cl.
*B66B 7/08* (2006.01)
*B66B 11/00* (2006.01)

(52) U.S. Cl.
CPC ..... *B66B 7/08* (2013.01); *B66B 11/008* (2013.01)

(58) Field of Classification Search
CPC ..... B66B 7/068; B66B 7/06
See application file for complete search history.

(56) References Cited

U.S. PATENT DOCUMENTS

2016/0376125 A1* 12/2016 Wells ..... B66B 5/02 187/266

FOREIGN PATENT DOCUMENTS

| | | | | |
|---|---|---|---|---|
| JP | 2004-250217 A | | 9/2004 | |
| JP | 2014-156298 A | | 8/2014 | |
| JP | 2014-234295 A | | 12/2014 | |
| JP | 2015-003772 A | | 1/2015 | |
| JP | 2016-169094 A | | 9/2016 | |
| WO | WO-2012015429 A1 | * | 2/2012 | ..... B66B 7/06 |
| WO | 201503342 A1 | | 3/2015 | |

OTHER PUBLICATIONS

Machine Translation of JP 2014234295.*

* cited by examiner

*Primary Examiner* — Diem M Tran
(74) *Attorney, Agent, or Firm* — Global IP Counselors, LLP

(57) ABSTRACT

An elevator includes a compensating sheave, a compensating rope, a guide, a holder, a driver, a lateral vibration detector, and driver controller. The compensating rope is looped around the compensating sheave to be bent back upward in a hoistway, and has a first end connected to a car and a second end connected a counterweight, the compensating rope suspended from the car and the counterweight. The guide guides the compensating sheave in a vertically displaceable manner. The holder holds the guide to be displaceable in a horizontal direction. The driver drives the holder in the horizontal direction. The lateral vibration detector detects lateral vibration of the compensating rope. The driver controller controls the driver based on a result of detection by the lateral vibration detector and accordingly drive the holder in the horizontal direction so as to dampen lateral vibration of the compensating rope.

6 Claims, 16 Drawing Sheets

ELEVATOR

CROSS-REFERENCE TO RELATED APPLICATION

This application is based on Japanese Patent Application No. 2019-212642, filed Nov. 25, 2019, the contents of which are hereby incorporated by reference.

BACKGROUND

Field of the Invention

The present invention relates to elevators, and more particularly relates to a technique of damping lateral vibration of a compensating rope for an elevator due to a long-period motion from earthquakes, for example.

Description of Related Art

Recently developed superhigh-rise buildings equipped with a roped elevator have a problem of not only the lateral vibration of the main ropes but also the lateral vibration of the compensating ropes when the building shakes due to a long-period earthquake or strong wind.

as can be understood, compensating ropes are suspended between the car and the counterweight. The elevator includes a compensating sheave in the pit at the lower part of the hoistway. The compensating sheave applies tension to the compensating ropes looped therearound to control vibration of the compensating ropes during normal operation.

That is, the compensating ropes are looped around the compensating sheave to be bent upward, and one end of the compensating ropes is connected to the car and the other end is connected to the counterweight. In this description, a portion of the compensating ropes between the car and the compensating sheave is called a "car-side compensating rope portion", and a portion of the compensating ropes between the counterweight and the compensating sheave is called a "counterweight-side compensating rope portion".

When the compensating ropes significantly vibrate in the horizontal direction (laterally vibrate), the laterally vibrating compensating ropes can contact a device installed in the hoistway, and can damage the device. Even after the building shake has stopped, the elevator operation cannot be resumed until the lateral vibration of the compensating ropes converge to a certain extent. Depending on the magnitude of the lateral vibration, maintenance work by maintenance personnel can be necessary, and this will degrade the service.

JP 4252330 B (JP 2004-250217 A) describes a device for damping the above-described lateral vibration of the compensating ropes in FIG. 8A and FIG. 8B and paragraph [0048]. As illustrated in FIG. 8A and FIG. 8B in JP 4252330 B (JP 2004-250217 A), a vibration damper 22 has a rope locking member 26 to lock the horizontal motion of the car-side compensating rope portion 7 and an actuator 25 to drive the rope locking member 26 in the horizontal direction. The vibration damper includes a rope-displacement sensor 33 above the rope locking member 26 to measure the horizontal displacement of the car-side compensating rope portion 7.

The vibration damper of JP 4252330 B (JP 2004-250217 A) is configured to cause the actuator 25 to drive the rope locking member 26 based on the detection result of the rope-displacement sensor 33 and so damp the swing of the car-side compensating rope portion 7 (Claim 1, paragraph [0051], for example, of JP 4252330 B (JP 2004-250217 A)).

The rope locking member 26 of the vibration damper 22 is placed in the hoistway at a portion lower than the lowest floor surface (in the pit) to avoid interference with the car 5 moving up and down. A compensating sheave 8 is installed in the pit. The rope locking member 26 therefore has to be placed at a position very close to the compensating sheave 8 relative to the entire length of the hoistway.

When the rope locking member 26 at a position close to the compensating sheave 8 displaces the compensating ropes 7 in the horizontal direction, the compensating ropes 7 can disengage from the compensating sheave 8. Hereinafter, this disengagement of the compensating ropes from the compensating sheave is called a "detachment".

If a detachment occurs, recovery work such as re-engagement of the compensating ropes around the compensating sheave is required, resulting in a significant deterioration in the elevator operation service.

SUMMARY

In view of the above-mentioned problem, the present invention provides an elevator capable of damping the lateral vibration of the compensating ropes while reducing or eliminating detachment of the ropes, as compared with the above-described conventional elevator including the vibration damper 22.

To achieve this and other objectives, an elevator according to an embodiment of the present invention includes a compensating rope that is looped around a compensating sheave and is bent back upward in a hoistway, and has a first end connected to a car and a second end connected a counterweight, the compensating rope being suspended from the car and the counterweight, and the elevator further includes: a guide member configured to guide the compensating sheave in a vertically displaceable manner; a holding unit configured to hold the guide member to be displaceable in a horizontal direction; a driving unit configured to drive the holding unit in the horizontal direction; a lateral vibration detection system configured to detect lateral vibration of the compensating rope; and a driving unit controller configured to control the driving unit based on a result of the detection by the lateral vibration detection system and accordingly drive the holding unit in the horizontal direction so as to damp lateral vibration of the compensating rope.

The elevator according to the present invention includes the holding unit that holds the guide members in a horizontally displaceable manner, the guide members guiding the compensating sheave in a vertically displaceable manner. The holding unit is driven in the horizontal direction based on a detection result of lateral vibration of the compensating rope so as to damp the lateral vibration.

As described above, conventional techniques dampen the lateral vibration of compensating ropes by horizontally displacing the compensating ropes at a portion close to the compensating sheave with the rope locking member. When the portion of the compensating ropes is to be displaced along the axial center direction of the compensating sheave, for example, the compensating ropes, which normally are orthogonal to the axial center of the compensating sheave in front view, will be greatly inclined from this orthogonal direction, and so will be detached from the compensating sheave.

The present invention is configured so that the compensating sheave having the compensating ropes looped around it is displaced in the horizontal direction. Even when the displacement is in the direction of the axial center of the compensating sheave, the distance between the compensating sheave and the car or the counterweight is considerably long, so the inclination from the orthogonal direction is small compared to the conventional techniques. The present invention therefore enables damping of the lateral vibration of the compensating ropes without detachment of the ropes compared to the conventional techniques.

BRIEF DESCRIPTION OF THE DRAWINGS

These and other objects, advantages and features of the invention will become apparent from the following description thereof taken in conjunction with the accompanying drawings which illustrate a specific embodiment of the invention in the drawing.

DETAILED DESCRIPTION

Figure 1:
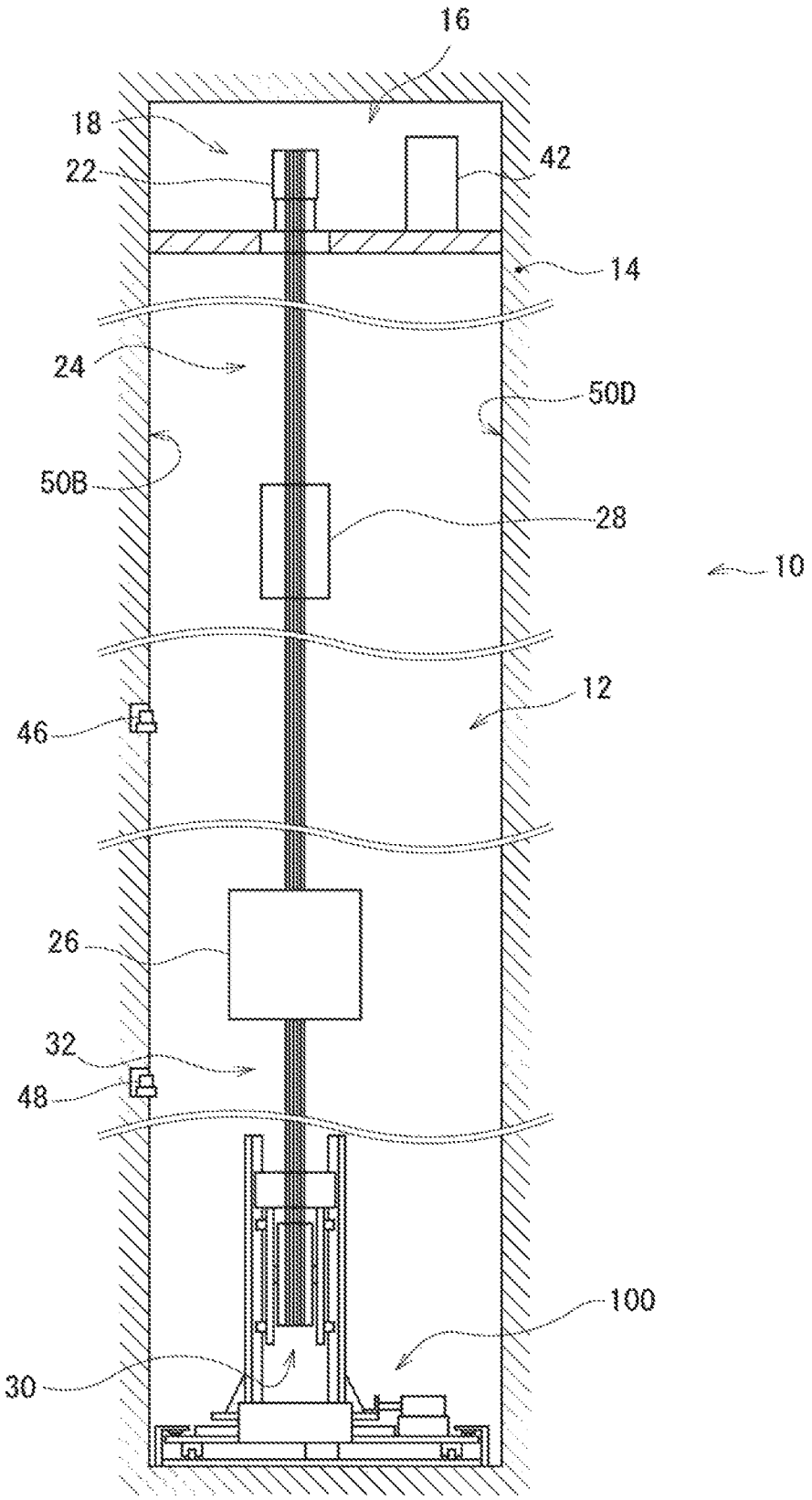
FIG. 1 is a front view schematically illustrating the configuration of an elevator according to one embodiment.

Referring to the drawings, the following describes one embodiment of the elevator according to the present invention. In the drawings, the scales between the elements are not necessarily unified.

Overall Structure

Figure 2:
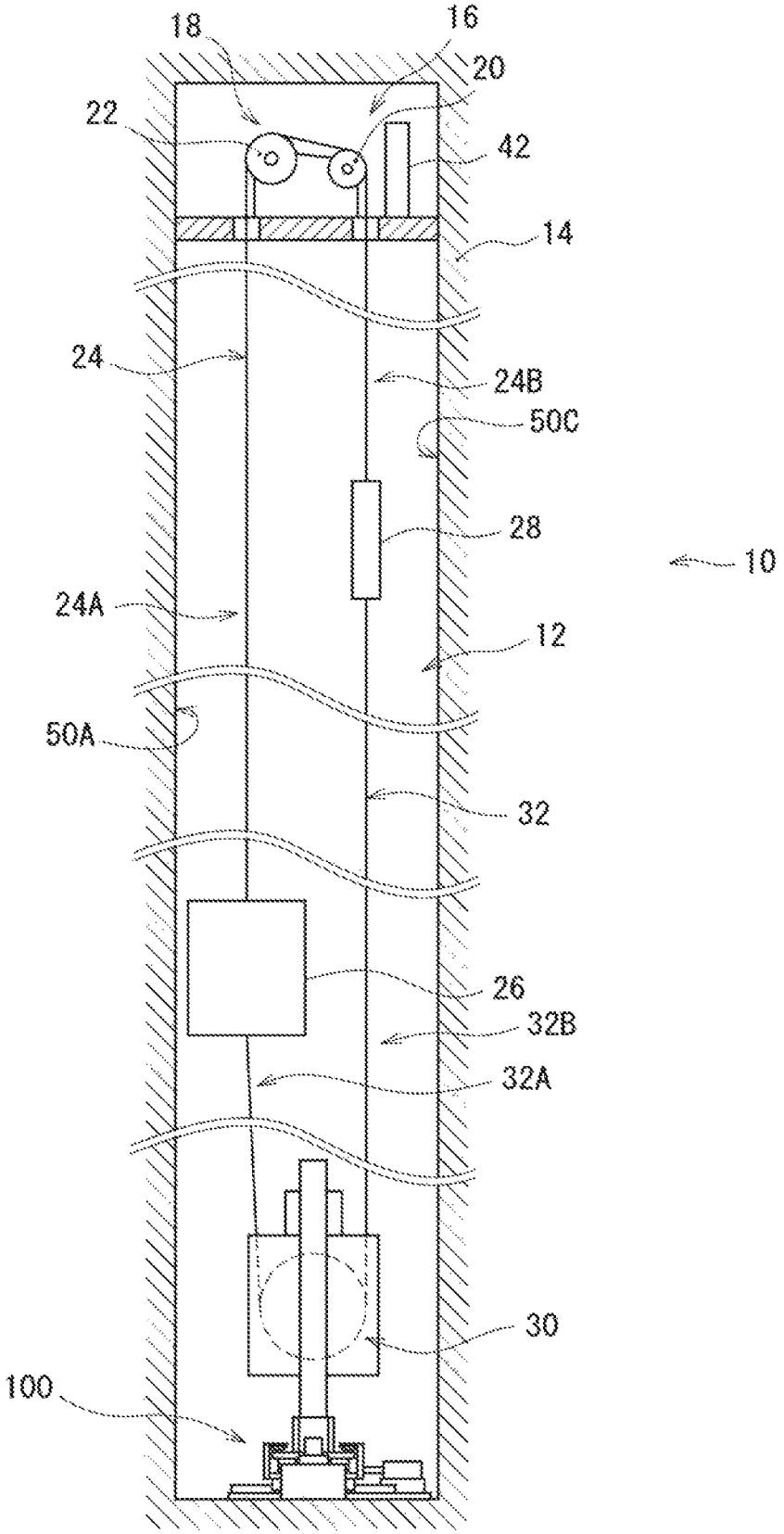
FIG. 2 is a right side view schematically illustrating the configuration of the elevator.

FIG. 1 is a front view of the interior of a hoistway 12 containing an elevator 10 according to one embodiment, viewed from an elevator hall (not illustrated). FIG. 2 is a right side view of the elevator 10. FIG. 2 omits laser range scanners 46 and 48 described later.

As illustrated in FIG. 1 and FIG. 2, the elevator 10 is a roped elevator of a traction-type as the drive system. The elevator includes a machine room 16 above the top of the hoistway 12 in the building 14. A hoist 18 and a deflector sheave 20 are installed in the machine room 16. A plurality of main ropes is looped around a sheave 22 making up the hoist 18 and around the deflector sheave 20. The plurality of main ropes will be called a "main rope group 24".

The main rope group 24 has one end connected to a car 26 and the other end connected to a counterweight 28. The car 26 and the counterweight 28 are suspended by the main rope group 24 in a traction manner.

Between the car 26 and the counterweight 28, a plurality of compensating ropes is suspended while engaged with a compensating sheave 30 at the lowermost end. In other words, the plurality of compensating ropes is looped around the compensating sheave 30 and is bent back upward, and is suspended between the car 26 and the counterweight 28 while having a first end connected to the car 26 and a second end connected to the counterweight 28.

This plurality of compensating ropes will be called a "compensating rope group 32". In this example, the number of main ropes making up the main rope group 24 and the number of compensating ropes making up the compensating rope group 32 are the same (6 in this example). The diameters of the main ropes and the compensating ropes are typically 10 mm to 20 mm. The number of main ropes of the main rope group 24 and the number of ropes of the compensating rope group 32 are not limited to the above-mentioned number, and may be any number depending on the specifications of the elevator.

Figure 6:
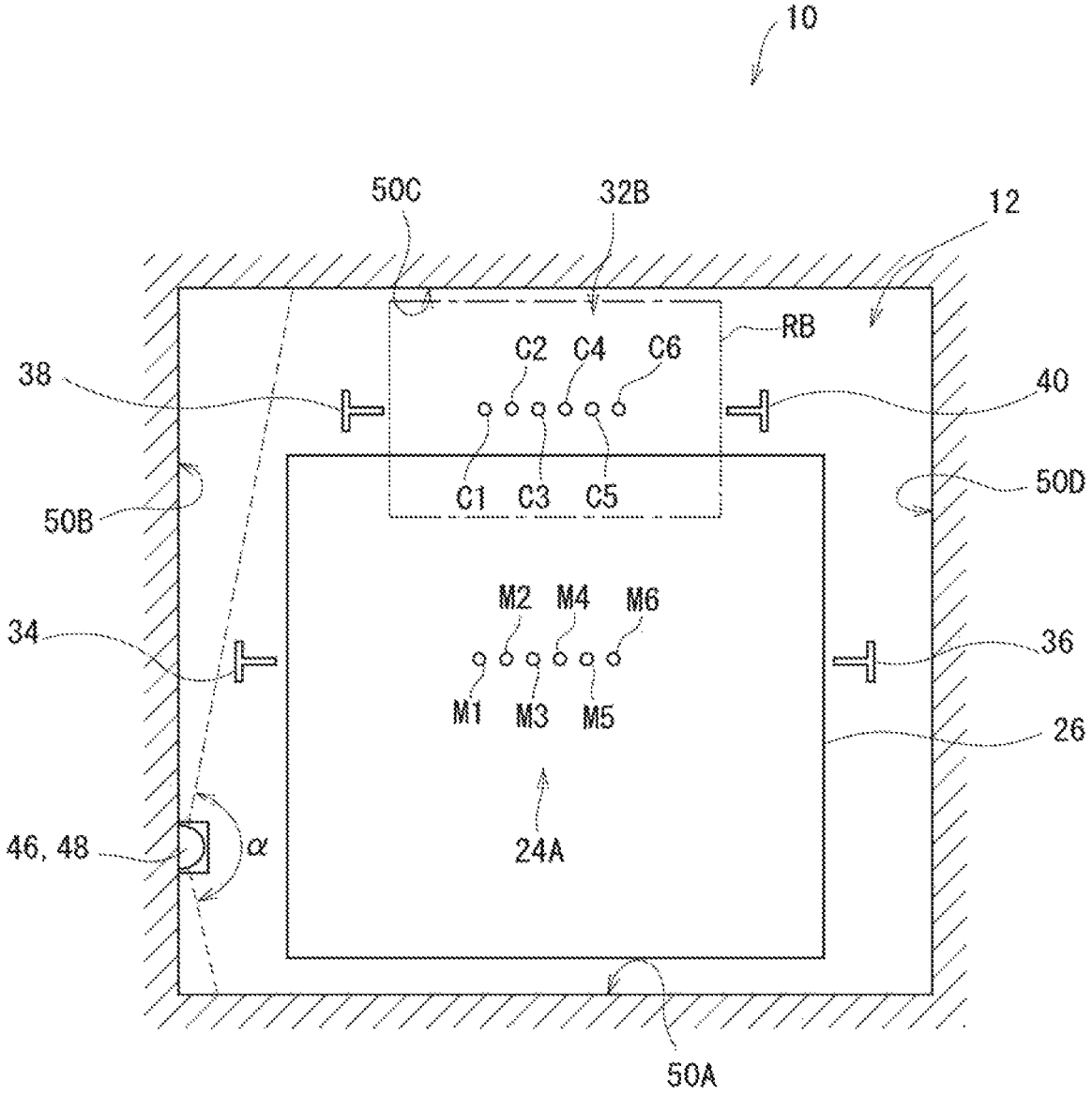
FIG. 6 is a plan view of the hoistway in which the elevator is installed, taken along near the upper part of a laser range scanner on the side wall of the hoistway, illustrating the car stopping below the laser range scanner and the counterweight stopping above the laser range scanner.
Figure 7:
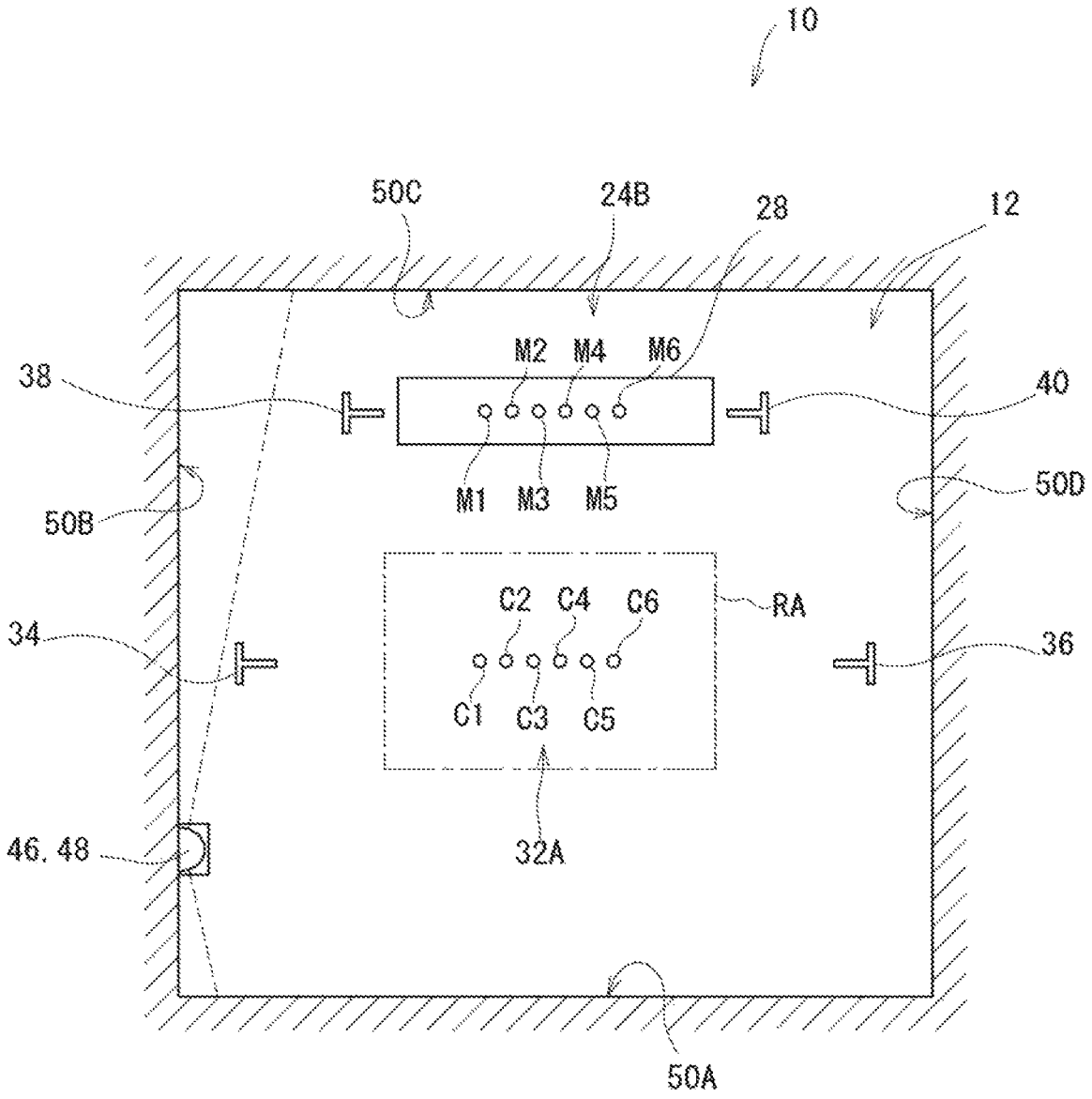
FIG. 7 is a plan view of the hoistway in which the elevator is installed, taken along near the upper part of a laser range scanner on the side wall of the hoistway, illustrating the car stopping above the laser range scanner and the counterweight stopping below the laser range scanner.

In the hoistway 12, a pair of car guide rails 34, 36 and a pair of counterweight guide rails 38, 40 extend vertically (both are not illustrated in FIGS. 1 and 2, see FIGS. 6 and 7).

In the elevator 10 having the above structure, when the sheave 22 is rotated normally or reversely by a hoist motor (not illustrated), the main rope group 24 looped around the sheave 22 moves, and the car 26 and the counterweight 28 suspended from the main rope group 24 accordingly move up and down in mutually opposite directions. Along with this movement, the compensating rope group 32 between the car 26 and the counterweight 28 moves while turning around the compensating sheave 30.

A control panel 42 is installed in the machine room 16. The control panel 42 has a power-supply unit (not illustrated) that supplies electricity to various devices (not illustrated) installed in the hoist 18 and the car 26, and a control circuit unit 44 (control circuit) (FIG. 8A) that controls the various devices.

The control circuit unit 44 has a configuration in which a ROM and a RAM are connected to the CPU (they are not illustrated). The CPU executes various control programs stored in the ROM to comprehensively control the hoist 18 and the like to implement the normal operation of the elevator through a smooth elevating operation of the car, and also implement an emergency operation to ensure the safety of passengers in case of an earthquake, for example.

As illustrated in FIG. 2, a portion of the main rope group 24 that suspends the car 26 is called a car-side main rope portion 24A, and a portion that suspends the counterweight 28 is called a counterweight-side main rope portion 24B. A portion of the compensating rope group 32 hanging down from the car 26 (a portion of the compensating rope group 32 between the car 26 and the compensating sheave 30) is called a car-side compensating rope portion 32A, and a portion hanging down from the counterweight 28 (a portion of the compensating rope group 32 between the counterweight 28 and the compensating sheave 30) is called a counterweight-side compensating rope portion 32B.

According to the above definition, the lengths (ranges) of the car-side main rope portion 24A and the counterweight-side main rope portion 24B occupying the main rope group 24 and the lengths (ranges) of the car-side compensating rope portion 32A and the counterweight-side compensating rope portion 32B occupying the compensating rope group 32 increase/decrease (vary) with the ascending/descending positions of the car 26 and the counterweight 28.

If the building 14 in which the elevator 10 having the above structure is installed is shaken by a long-period earthquake or strong wind, the long objects, such as the main rope group 24 and the compensating rope group 32, suspended in the hoistway 12 laterally vibrate. (This lateral vibration is also called "lateral oscillations").

As illustrated in FIG. 1, the elevator includes laser range scanners 46 and 48 on the side walls of the hoistway 12 to detect the lateral vibration. The laser range scanner 46 is placed at a center position of the hoistway 12 in the vertical direction. The laser range scanner 48 is placed at a height of ¼ of the overall length (overall height) of the hoistway 12 from the bottom of the hoistway 12. Detection of lateral vibration using the laser range scanners 46 and 48 will be described later.

Mechanism to Damp Lateral Vibration of Compensating Ropes

Figure 3:
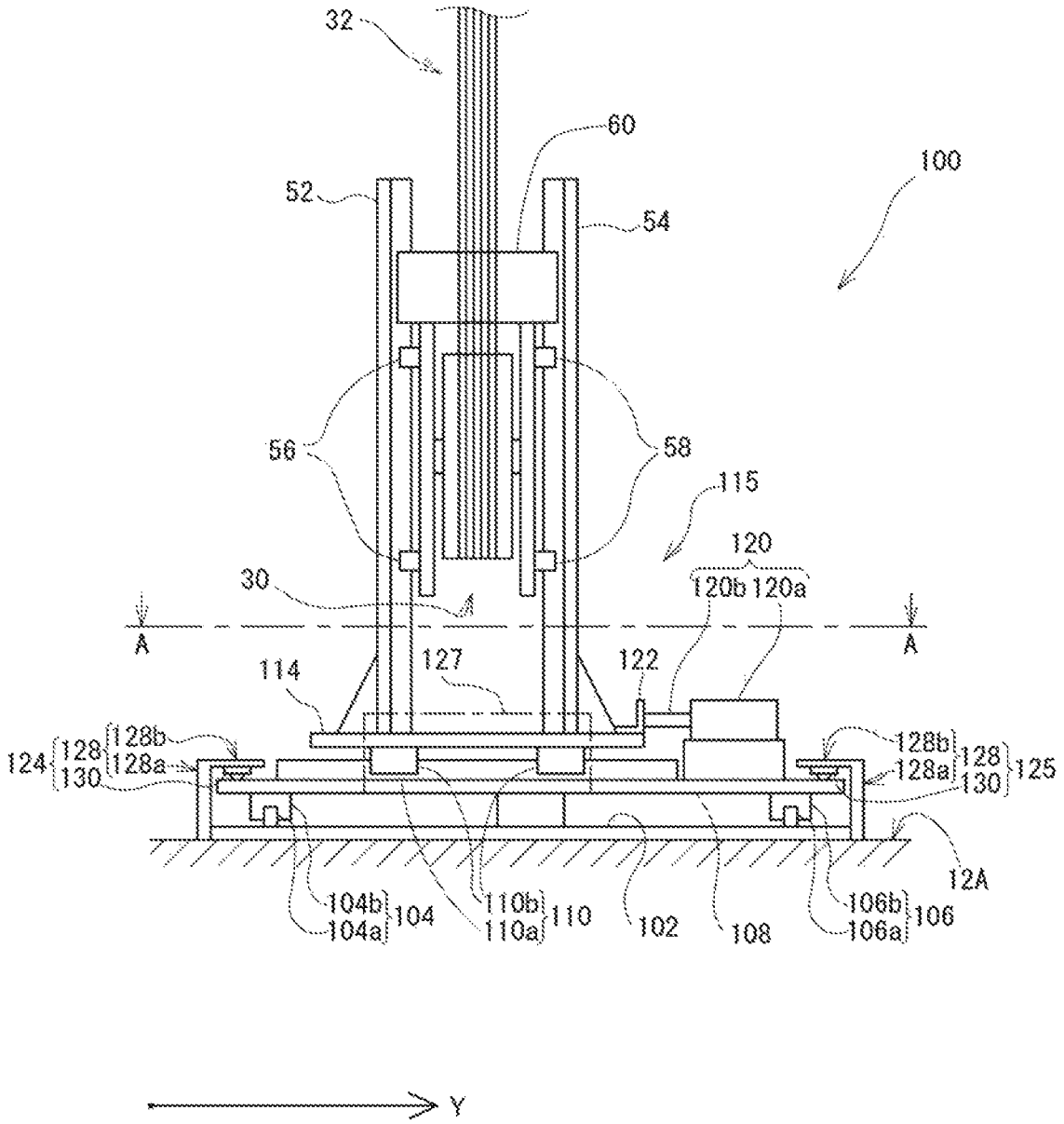
FIG. 3 is a front view of a lateral-vibration damper mechanism for compensating ropes included in the elevator.
Figure 4:
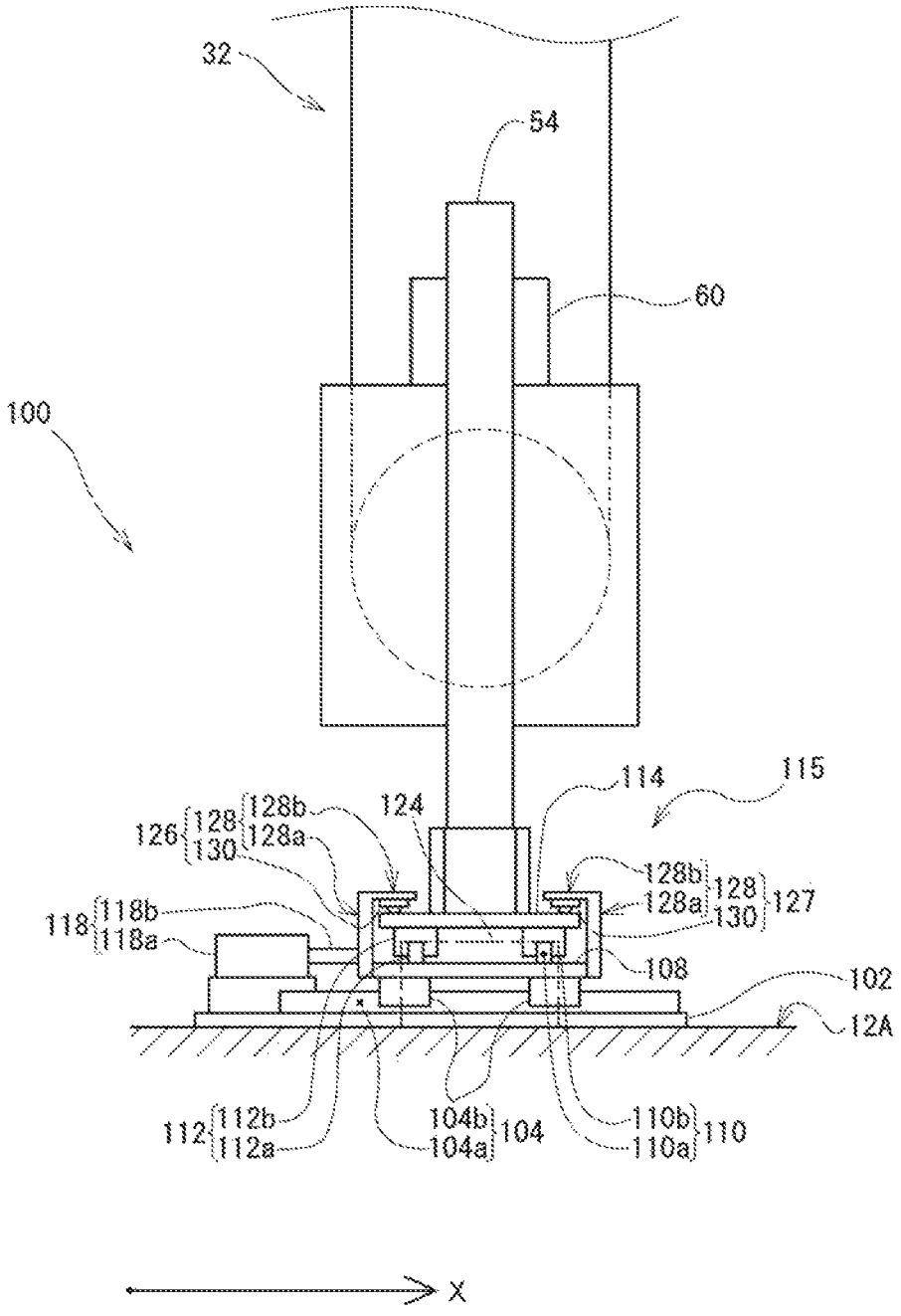
FIG. 4 is a left side view of the lateral-vibration damper mechanism.

Referring to FIGS. 3, 4, and 5, the following describes a lateral-vibration damper mechanism 100 to dampen the lateral vibration of the compensating rope group 32 due to a long-period earthquake motion, for example.

Figure 5A:
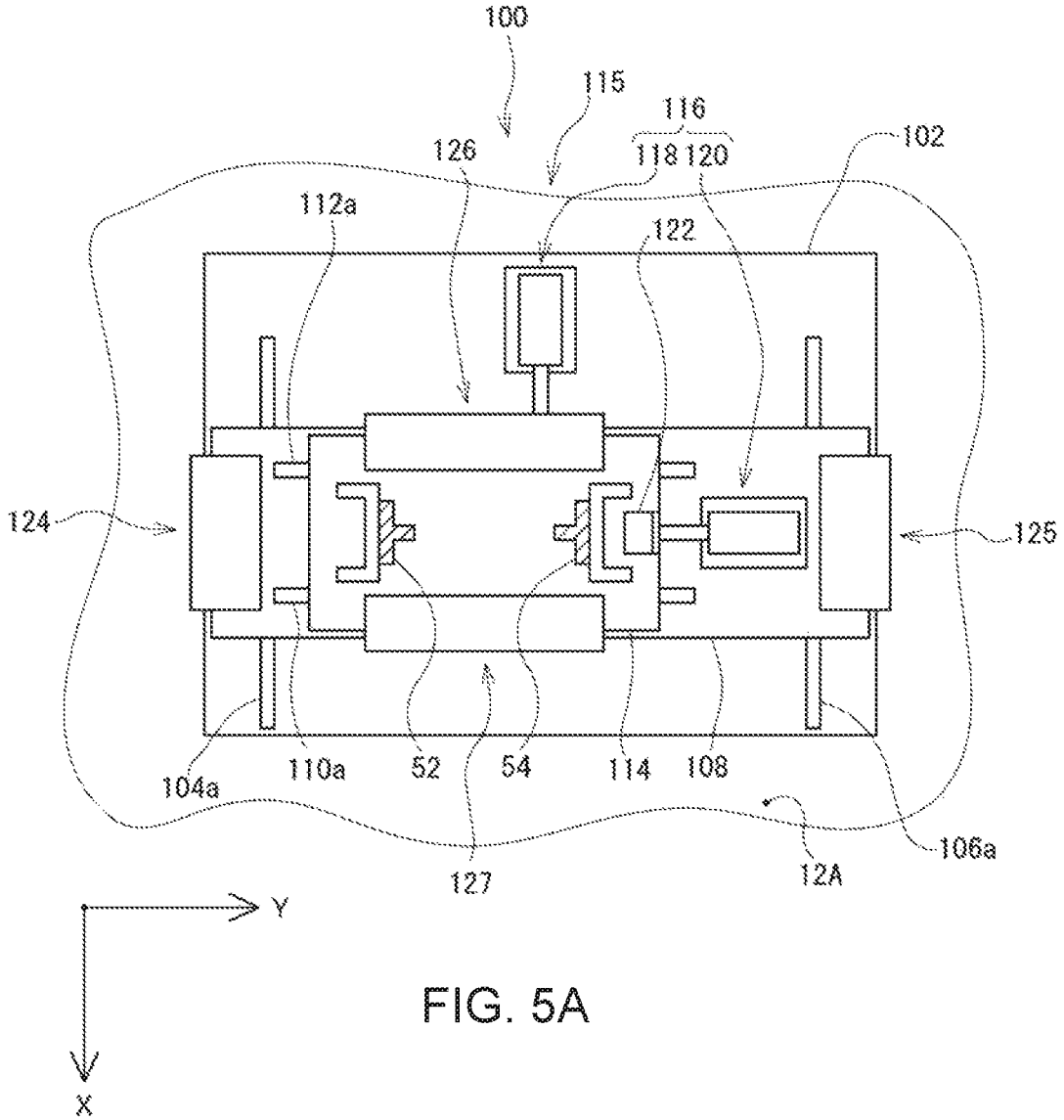
FIG. 5A is a plan view of the lateral-vibration damper mechanism taken along the line A-A in FIG. 3.

FIG. 3 is a front view of the lateral-vibration damper mechanism 100, and FIG. 4 is a left side view of it. FIG. 5A is a plan view of FIG. 3 taken along the line A-A. FIG. 3 omits a stopper 127 described later, and illustrates the installation position of the stopper 127 with a dashed-dotted line. FIG. 4 omits a stopper 124 described later, and illustrates the installation position of the stopper 124 with a dashed-dotted line.

Referring to the XY rectangular coordinates of FIG. 5A, the positional relationship of the elements of the lateral-vibration damper mechanism 100 will be described below. In this example, the X axis is in the same direction as the horizontal direction of sidewalls 50B and 50D (FIGS. 6 and 7) described later. The Y-axis is the same as the direction along the horizontal direction of sidewalls 50A and 50C (FIGS. 6 and 7) described later. The Y axis and the X axis are illustrated in FIGS. 3 and 4, respectively, according to the X and Y rectangular coordinates of FIG. 5A.

The lateral-vibration damper mechanism 100 has a base 102 made of a steel plate that is fixed to the floor face 12A of the pit, which is a bottom of the hoistway 12. In one example, the base 102 is fixed to the floor face 12A with anchor bolts (not illustrated).

A first stage 108 is mounted on the base 102 via known linear motion guides 104 and 106. The linear motion guide 104 has a rail 104*a* and a plurality of (two in this example) sliders 104*b*. The linear motion guide 106 also has a rail 106*a* and a plurality of (two in this example) sliders 106*b*.

The two rails 104*a* and 106*a* extend on the base 102 parallel to the X axis. The sliders 104*b* and 106*b* are attached to the first stage 108. With this configuration, the first stage 108 is slidable in the X-axis direction relative to the floor face 12A that is the bottom of the hoistway 12.

A second stage 114 is mounted on the first stage 108 via known linear motion guides 110 and 112. The linear motion guide 110 has a rail 110*a* and a plurality of (two in this example) sliders 110*b*. The linear motion guide 112 also has a rail 112*a* and a plurality of (two in this example) sliders 112*b*.

The two rails 110*a* and 112*a* extend on the first stage 108 parallel to the Y axis. The sliders 110*b* and 112*b* are attached to the second stage 114. With this configuration, the second stage 114 is slidable in the Y-axis direction intersecting (in this example, orthogonal to) the X-axis relative to the first stage 108 and accordingly to the floor face 12A.

As will be described later, guide rails 52, 54 are fixed to the second stage 114 and guide the compensating sheave 30 in a vertically displaceable manner. With this configuration, the guide rails 52, 54 are held so as to be displaceable in the horizontal directions of the X-axis direction and the Y-axis direction. That is, the base 102, the first stage 108, the linear motion guides 104 and 106, the second stage 114, and the linear motion guides 110 and 112 constitute a holding unit (holder) 115 that holds the guide rails 52 and 54 to be horizontally displaceable.

The lateral-vibration damper mechanism 100 includes a driving unit (driver) 116. The driving unit 116 drives the first stage 108 and the second stage 114 of the holding unit 115 in the horizontal directions. As illustrated in FIG. 5A, the driving unit 116 includes actuators 118 and 120. The actuators 118 and 120 are known hydraulic linear actuators, and have cylinders 118*a* and 120*a* and rods 118*b* and 120*b*, respectively, as illustrated in FIGS. 4 and 3. The actuators 118 and 120 are not limited to hydraulic type actuators, and may be known electric linear actuators.

The cylinder 118*a* of the actuator 118 is fixed to the base 102, and the tip end of the rod 118*b* is connected to the first stage 108 via a body 128 of a stopper 126 described later. As the actuator 118 acts to move the rod 118*b* forward and backward relative to the cylinder 118*a*, the first stage 108 accordingly is driven in the X-axis direction.

The cylinder 120*a* of the actuator 120 is fixed to the first stage 108, and the tip end of the rod 120*b* is connected to the second stage 114 via a bracket 122. As the actuator 120 acts to move the rod 120*b* forward and backward relative to the cylinder 120*a*, the second stage 114 accordingly is driven in the Y-axis direction relative to the first stage 108.

The guide rails 52 and 54 can be considered a guide member and are disposed upright on the second stage 114 to guide the compensating sheave 30 to be vertically displaceable. The guide rails 52 and 54 guide the compensating sheave 30 via guide shoes 56 and 58. The compensating sheave 30 is locked to be horizontally movable relative to the second stage 114 by the guide rails 52 and 54, and is held to be vertically displaceable as stated above. This means that tension equal to the weight of the compensating sheave 30 is applied to the compensating rope group 32. That is, the compensating sheave 30 is to apply tension to the compensating rope group 32.

The compensating sheave 30 includes a known tie-down device 60. The tie-down device 60 prevents the compensating sheave 30 from jumping up. If a known safety device (not illustrated) installed at the car 26 acts to suddenly stop the descending car 26, the ascending counterweight 28 keeps ascending due to inertia. In this situation, the compensating sheave 30 may jump up because the counterweight 28 pulls the compensating sheave 30 through the compensating rope group 32, and the compensating sheave 30 may come off the guide rails 52 and 54. The tie-down device 60 prevents the compensating sheave 30 from coming-off the guide rails 52 and 54. The tie-down device 60 holds the guide rails 52 and 54 so as to brake the upward movement of the compensating sheave 30.

Typical guide rails that vertically guide a compensating sheave are fixed to the pit floor, and this configuration with the tie-down device 60 therefore prevents a compensating sheave from jumping up. The guide rails 52 and 54 in this embodiment, however, are just fixed to the second stage 114, and so the guide rails 52 and 54 will jump up together with the second stage 114 without any countermeasure, which can damage the lateral-vibration damper mechanism 100.

To avoid this, the present embodiment includes a preventive device (preventor) to prevent the jumping up of the guide rails 52 and 54 if a situation activates the tie-down device 60. The preventive device includes a pair of stoppers 124 and 125 and a pair of stoppers 126 and 127.

Figure 5B:
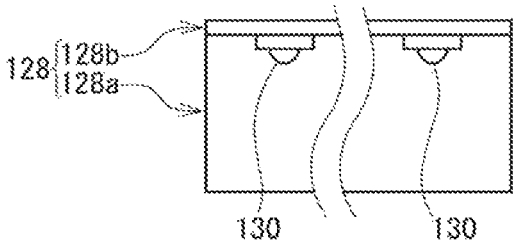
FIG. 5B is a front view of a stopper making up the lateral-vibration damper mechanism.
Figure 5C:
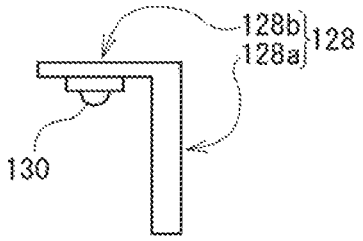
FIG. 5C is a right side view of the stopper.

The stoppers 124 and 125 and the stoppers 126 and 127 basically have the same configuration except that the entire lengths are different. Therefore, these stoppers will be collectively described below with reference to FIGS. 5B and 5C. FIG. 5B is a front view of the stoppers 124 to 127, and FIG. 5C is a right side view of them.

The stoppers 124 to 127 each include a body 128 made of shaped steel having an L-shaped cross section. The body 128 stands to have an inverted L-shape in use. As illustrated in FIG. 5C, a vertically standing portion is called a vertical plate portion 128*a*, and a portion protruding horizontally from the upper end of the vertical plate portion 128*a* is called a horizontal plate portion 128*b*.

The stoppers 124 to 127 each also include one or a plurality of ball rollers 130 attached to the lower face of the horizontal plate portion 128*b*.

As illustrated in FIG. 3, the stoppers 124 and 125 each have the lower end of the vertical plate portion 128*a* fixed to the base 102. Each horizontal plate portion 128*b* overlaps the upper face of the first stage 108 in a plan view, so that the ball roller 130 is in contact with the upper face of the first stage 108.

The stoppers 124 and 125 control the upward displacement of the first stage 108 relative to the base 102. As is apparent from the installation modes illustrated in FIGS. 3 and 5A, the stoppers 124 and 125 do not hinder the displacement of the first stage 108 in the X-axis direction.

As illustrated in FIG. 4, the stoppers 126 and 127 each have the lower end of the vertical plate portion 128*a* fixed to the first stage 108. Each horizontal plate portion 128*b* overlaps the upper face of the second stage 114 in a plan view, so that the ball roller 130 is in contact with the upper face of the second stage 114.

The stoppers 126 and 127 control the upward displacement of the second stage 114 relative to the first stage 108. As is apparent from the installation modes illustrated in FIGS. 4 and 5A, the stoppers 126 and 127 do not hinder the displacement of the second stage 114 in the Y-axis direction.

As described above, the base 102 is fixed to the floor face 12A of the pit, and the upward displacement of the first stage 108 relative to the base 102 is controlled by the stoppers 124 and 125. The upward displacement of the second stage 114 relative to the first stage 108 is controlled by the stoppers 126 and 127, and the guide rails 52 and 54 are fixed to the second stage 114.

In this way, the upward displacement of the guide rails 52, 54 relative to the pit floor face 12A is controlled by the preventive device including the pair of stoppers 124, 125 and the pair of stoppers 126, 127, and so this configuration reliably prevents the compensating sheave 30 from jumping up when the tie-down device 60 operates.

The above-described lateral-vibration damper mechanism 100 is configured so that one or both of the actuator 118 and the actuator 120 acts to horizontally move one or both of the first stage 108 and the second stage 114, and so displace the guide rails 52 and 54 and accordingly the compensating sheave 30 having the compensating rope group 32 looped around it in any direction within the horizontal plane. In this way the lateral-vibration damper mechanism 100 damps the lateral vibration of the compensating rope group 32. The actuation control by the actuator 118 and the actuator 120 is described later.

System to Detect Lateral Vibration of Compensating Ropes

Next the following describes the system to detect lateral vibration, including the laser range scanners 46 and 48 (FIG. 1). The laser range scanner 46 and the laser range scanner 48 are the same sensor except that the installation positions in the vertical direction are different. The following therefore describes one or both of the laser range scanners 46 and 48 as appropriate.

As illustrated in FIGS. 6 and 7, the hoistway 12 in this example is a space surrounded by four side walls 50. When it is necessary to distinguish these four side walls 50, letters "A", "B", "C" and "D" will be added to reference numeral "50". The laser range scanners 46 and 48 are placed on the side wall 50B. As illustrated in FIG. 1, FIG. 6, and FIG. 7, the laser range scanners 46 and 48 are placed outside the ascending/descending path of the car 26 and the counterweight 28.

The laser range scanners 46 and 48 measure the direction and the distance of an object (typically a plurality of objects) in the hoistway 12 existing on the horizontal planes including their installation positions from their installation positions, and output the measured direction and distance as two-dimensional position data. The two-dimensional position data is in a polar coordinate format. The horizontal planes will also be called a "scan plane".

In one example, the laser range scanners 46 and 48 are known two-dimensional laser range scanners that measure the distance from the installation positions of the laser range scanners 46 and 48 to an object. Laser range scanners are time-of-flight sensors that emit a laser beam at a predetermined angular interval (for example, 0.125 degree) to scan the horizontal plane in a fan shape, measure the round trip time to the object for each emitted laser beam, and convert the time to a distance. The time per scan (scan time) is 25 msec, for example, and the number of scans per second is 40. The scanning angle α of the laser range scanners 46 and 48 is close to 180 degrees as illustrated in FIG. 6, and the scanning range covers almost the entire hoistway 12 on the horizontal plane including the installation positions of the laser range scanners 46 and 48.

When the car 26 is located below the laser range scanner 48, the car-side main rope portion 24A and the counterweight-side compensating rope portion 32B are in the scan planes of the laser range scanners 46 and 48 as illustrated in FIG. 6.

When the counterweight 28 is located below the laser range scanner 48, the car-side compensating rope portion 32A and the counterweight-side main rope portion 24B are in the scan planes of the laser range scanners 46 and 48 as illustrated in FIG. 7.

Although not illustrated, when both the car 26 and the counterweight 28 are located above the laser range scanner 48, the car-side compensating rope portion 32A and the counterweight-side compensating rope portion 32B are in the scan plane of the laser range scanner 48.

As illustrated in FIG. 6 and FIG. 7, a plurality of (six in this example) main ropes M1 to M6 making up the main rope group 24 is arranged at equal intervals in this order. A plurality of (six in this example) compensating ropes C1 to C6 making up the compensating rope group 32 is also arranged at equal intervals in this order.

Next, the following describes a method for detecting lateral vibration of the compensating rope group 32 using the laser range scanners 46 and 48.

Figure 8A:
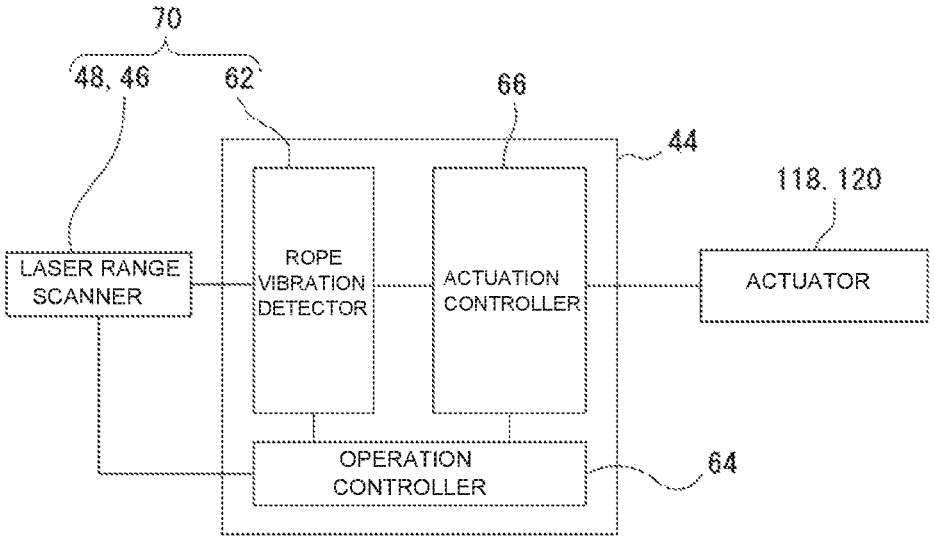
FIG. 8A is a functional block diagram of a control circuit unit.

The two-dimensional position data from the laser range scanners 46 and 48 is input to a rope vibration detector 62 of the control circuit unit 44 illustrated in FIG. 8A. The control circuit unit 44 includes an operation controller 64 and an actuation controller 66 in addition to the rope vibration detector 62. As described above, the operation controller 64 controls various devices to implement the normal operation and the emergency operation.

The operation controller 64 selects a laser range scanner between the laser range scanners 46 and 48 to be used for detecting the compensating rope group 32 based on the vertical position of the car 26. Specifically the selection is as follows:

(i) when the car 26 is located below the laser range scanner 48, the laser range scanner 46 is selected;

(ii) when the counterweight 28 is located below the laser range scanner 48, the laser range scanner 46 is selected; and (iii) when both the car 26 and the counterweight 28 are located above the laser range scanner 48, the laser range scanner 48 is selected.

The actuation controller 66 controls the actuation by the actuators 118 and 120, the details of which will be described later.

Figure 8B:
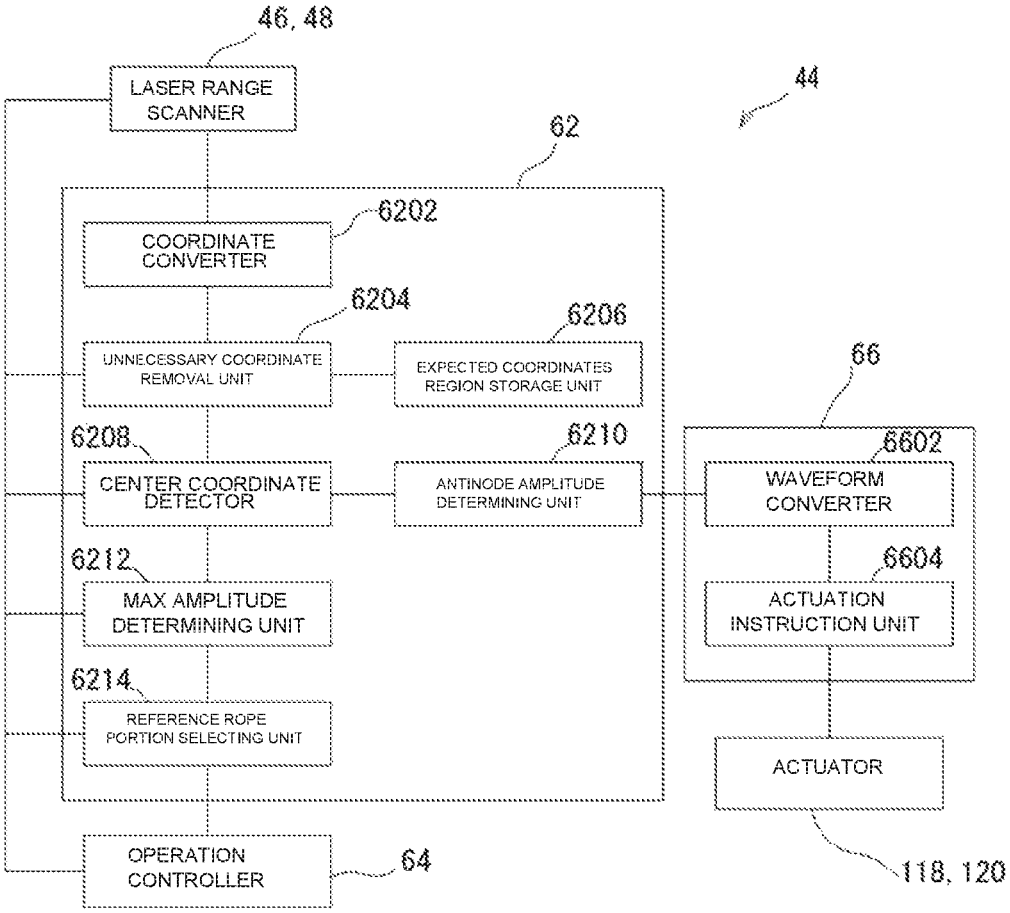
FIG. 8B is a detailed functional block diagram of a rope vibration detector and an actuation controller.

The two-dimensional position data output from one of the laser range scanners 46 and 48 is in the polar coordinate format. The coordinate converter 6202 illustrated in FIG. 8B of the rope vibration detector 62 converts this two-dimensional position data into the rectangular coordinates (xy rectangular coordinates) in a coordinate plane set on the horizontal plane.

Figure 9A:
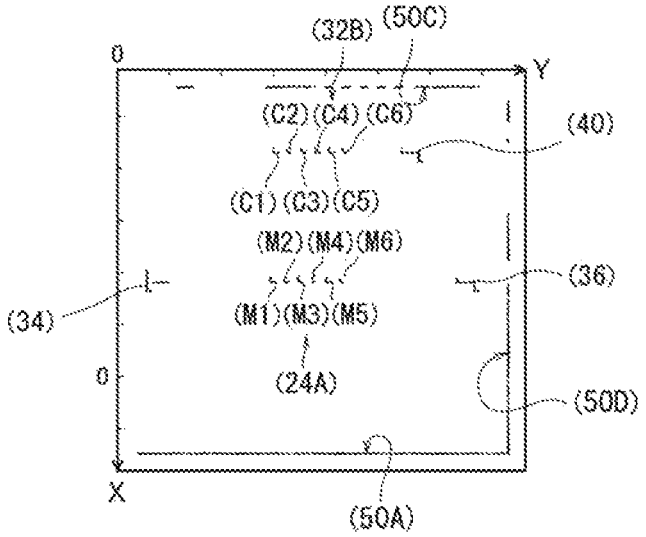
FIGS. 9A, 9B, and 9C are diagrams illustrating an example, in which coordinates data of an object detected during one scanning by the laser range scanner is plotted.
Figure 9B:
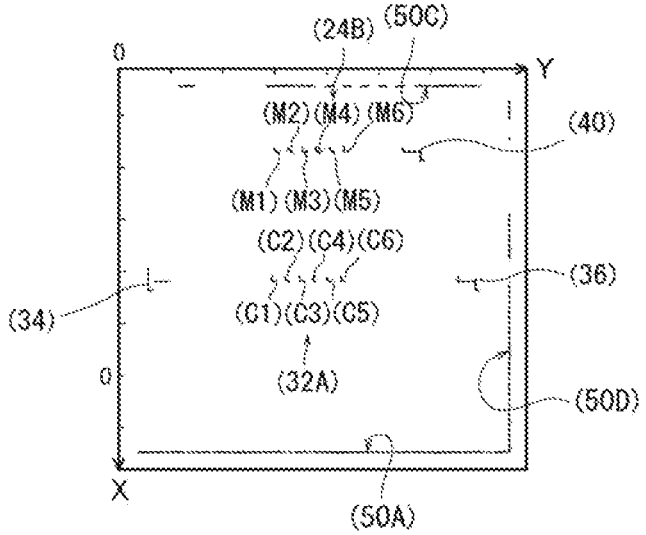
Figure 9C:
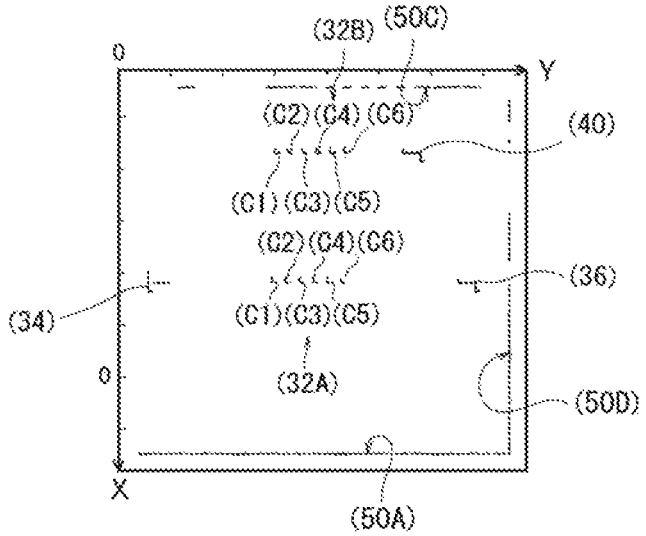

In one example, these rectangular coordinates are xy rectangular coordinates as illustrated in FIG. 9A-9C having the origin at the installation position of the laser range scanner 46 (not illustrated in FIG. 9A-9C). The x-axis direction and the y-axis direction in the xy rectangular coordinates illustrated in FIG. 9A-9C correspond to the X-axis direction and the Y-axis direction in the XY rectangular coordinates illustrated in FIG. 5A, respectively.

FIG. 9A plots the coordinates (hereinafter called "coordinates data") of an object detected during one scanning when the car-side main rope portion 24A and the counterweight-side compensating rope portion 32B are within the scan range of the laser range scanner 46 (the state illustrated in FIG. 6).

FIG. 9B plots the coordinates data of an object detected during one scanning when the car-side compensating rope portion 32A and the counterweight-side main rope portion 24B are within the scan range of the laser range scanner 46 (the state illustrated in FIG. 7).

FIG. 9C plots the coordinates data of an object detected during one scanning when the car-side compensating rope portion 32A and the counterweight-side compensating rope portion 32B are within the scan range of the laser range scanner 48.

Figure 10A:
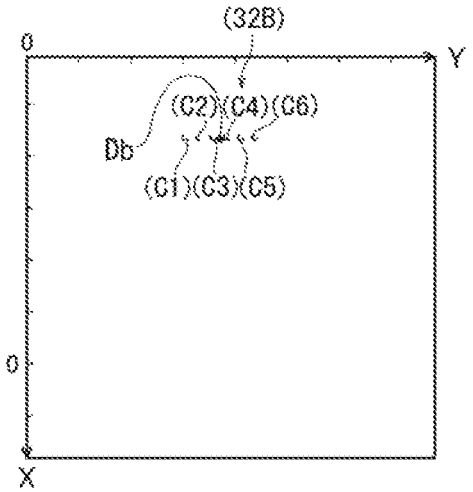
FIGS. 10A, 10B, and 10C illustrate the result after an unnecessary coordinate removal unit of the control circuit unit removes unnecessary coordinates data from the coordinates data of FIGS. 9A, 9B, and 9C.
Figure 10B:
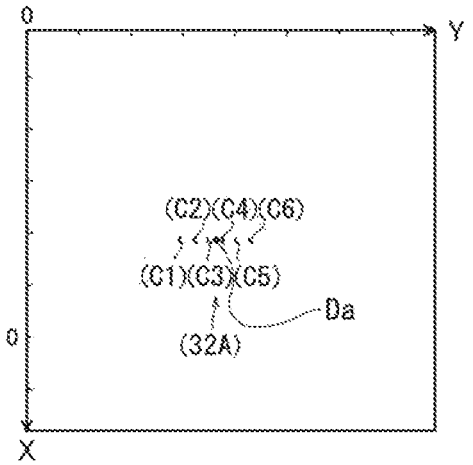
Figure 10C:
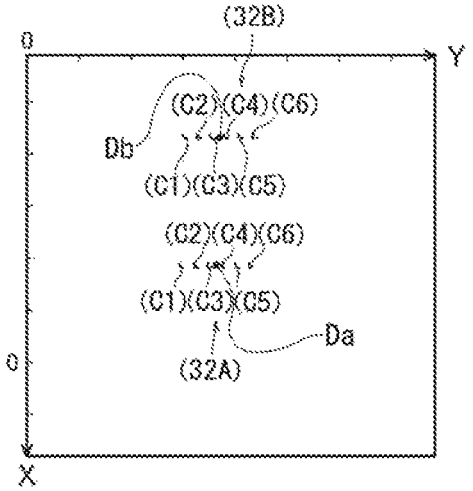

In FIGS. 9A, 9B, and 9C, the reference numeral of the object corresponding to the plotted coordinates data are described in parentheses (the same applies to FIG. 10A-10C).

As can be understood from the detection principle of the laser range scanners 46 and 48 described above, when a first object is detected, a second object (or a part thereof) may be hidden behind the first object viewed from the laser range scanners 46 and 48, and this second object is not detected by the laser range scanners. For example, in FIG. 9A, a part of the side wall 50C is not detected. This is because the part is hidden behind the guide rail 34 and the counterweight-side compensating rope portion 32B when viewed from the laser range scanner 48. At the installation position of the laser range scanner 48 in this example, the counterweight guide rail 34 (FIG. 6) is hidden behind the car guide rail 36 and so is not detected at all.

The necessary data in this example are the coordinates data on the compensating rope group 32 that is the target of lateral-vibration detection, and the coordinates data on parts other than the compensating rope group 32, such as on the car guide rails 34 and 36, the counterweight guide rails 38 and 40, and the side walls 50 interferes with the identification of the compensating rope group 32.

The present embodiment therefore assumes the expected range of lateral vibration that can occur in the compensating rope group 32, and sets in advance, on the scan planes (horizontal planes) of the laser range scanners 46 and 48, the expected coordinates regions RA and RB (the regions surrounded by a dashed-dotted line in FIGS. 6 and 7) in which only the car-side compensating rope portion 32A and the counterweight-side compensating rope portion 32B are expected to be present. The positions of the expected coordinates regions RA and RB on the coordinate planes are stored in an expected coordinates region storage unit (expected coordinates region storage) 6206 of the rope vibration detector 62.

As described above, the two-dimensional position data output from the laser range scanners 46 and 48 is input to the coordinate converter 6202, and the coordinate converter 6202 converts the polar coordinates into rectangular coordinates. The converted coordinates (coordinates data) are output from the coordinate converter 6202 and are input to an unnecessary coordinate removal unit (unnecessary coordinate remover) 6204.

The unnecessary coordinate removal unit 6204 refers to the expected coordinates regions RA and RB stored in the expected coordinates region storage unit 6206, and outputs only the coordinates data that belongs to the expected coordinates regions RA and RB of the coordinates data of the object from the coordinate converter 6202. The output coordinates data are then input to a center coordinate detector 6208. In other words, the unnecessary coordinate removal unit 6204 removes coordinates data belonging to the region outside the expected coordinates regions RA and RB from the coordinates data of the object that is output from the coordinate converter 6202 and outputs the resultant coordinates data. The output coordinates data is then input to the center coordinate detector 6208.

FIG. 10A plots the coordinates data, which are output to the center coordinate detector 6208, on the rectangular coordinates in the case of the above (i) (FIG. 6).

FIG. 10B plots the coordinates data, which are output to the center coordinate detector 6208, on the rectangular coordinates in the case of the above (ii) (FIG. 7).

FIG. 10C plots the coordinates data, which are output to the center coordinate detector 6208, on the rectangular coordinates in the case of the above (iii) (not illustrated).

As illustrated in FIG. 10A, FIG. 10B, and FIG. 10C, the coordinates data input to the center coordinate detector 6208 are only the coordinates data on an object present in either or both of the expected coordinates regions RA and RB, i.e., on either or both of the car-side compensating rope portion 32A and the counterweight-side compensating rope portion 32B.

A plurality of pieces of coordinates data is typically present in each of the expected coordinates region RA and the expected coordinates region RB. The following collectively refers to these pieces of coordinates data in each of the expected coordinates regions RA and RB as a "coordinates data group".

The center coordinates of the coordinate data group in the expected coordinates region RA are Da, and the center coordinates of the coordinate data group in the expected coordinates region RB are Db. The center coordinates are the arithmetic mean of a plurality of pieces of coordinates data that makes up the coordinate data group.

The center coordinate detector 6208 detects the center coordinates Da and the center coordinates Db. The center coordinates Da are the center coordinates of the car-side compensating rope portion 32A on the coordinates plane, and the center coordinates Db are the center coordinates of the counterweight-side compensating rope portion 32B on the coordinates plane.

When the car-side compensating rope portion 32A and the counterweight-side compensating rope portion 32B laterally vibrate during the shaking of the building 14 due to a long-period earthquake or strong wind, each of the compensating ropes C1 to C6 that make up these portions laterally vibrates independently. When there is no obstacle, these ropes basically vibrate laterally with the same behavior. That is, these ropes laterally vibrate while keeping the arrangement illustrated in FIGS. 7 and 6.

This means that individual behavior of the compensating ropes C1 to C6 can be detected through the detection of the behavior of the center coordinates Da of the car-side compensating rope portion 32A and of the center coordinates Db of the counterweight-side compensating rope portion 32B. The present embodiment therefore detects the behavior of the car-side compensating rope portion 32A and of the counterweight-side compensating rope portion 32B based on the center coordinates Da and Db.

Figure 11A:
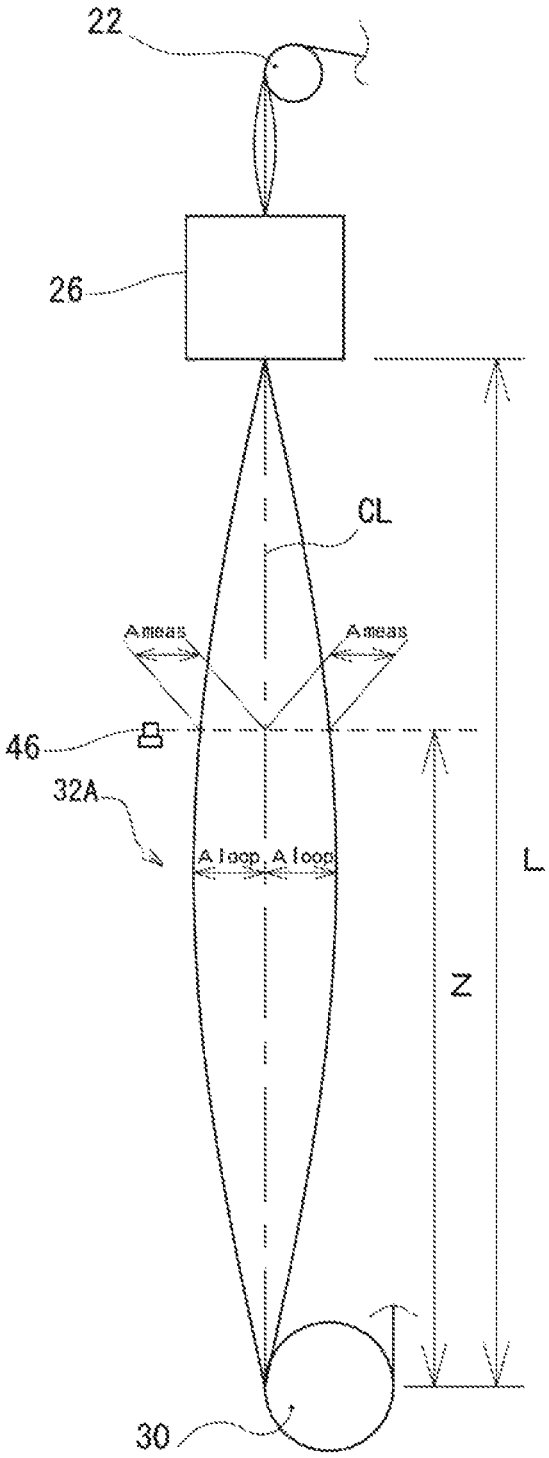
FIG. 11A and FIG. 11B is a diagram for explaining definitions of terms related to lateral oscillations in the descriptions.
Figure 11B:
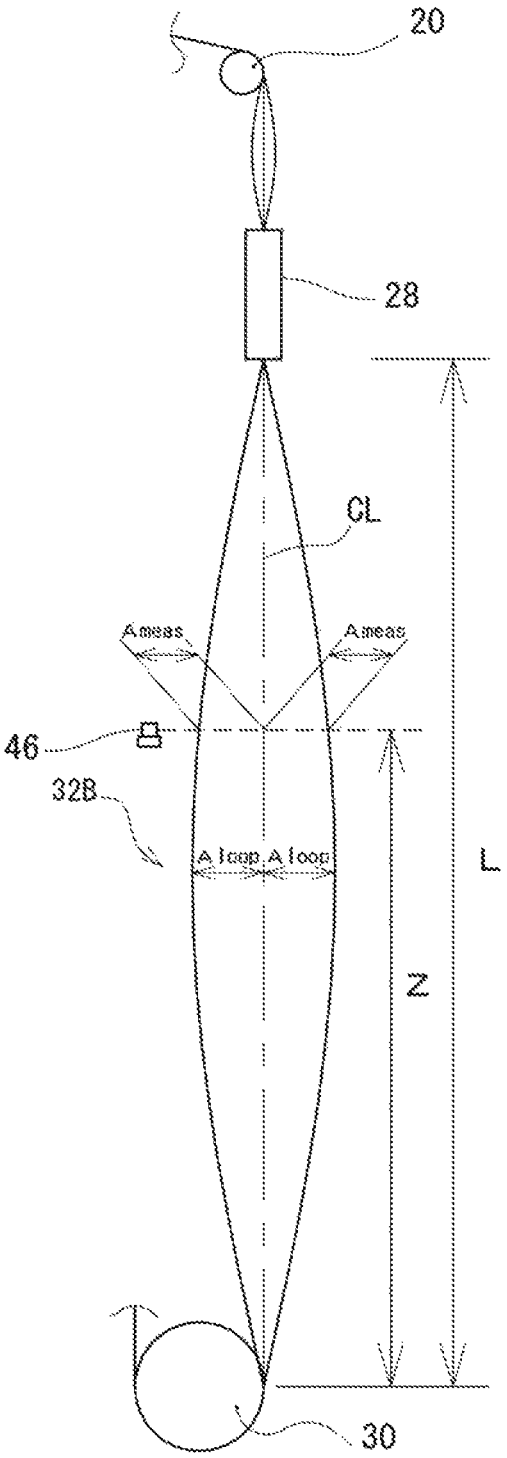

Referring now to FIG. 11A and FIG. 11B, the following defines the lateral oscillations of the car-side compensating rope portion 32A and the counterweight-side compensating rope portion 32B.

FIG. 11A illustrates the lateral vibration when the counterweight 28 (not illustrated in FIG. 11B, see FIG. 1) is located below the laser range scanner 46, and FIG. 11B illustrates the lateral vibration when the car 26 (not illustrated in FIG. 11A, see FIG. 1) is located below the laser range scanner 46.

FIG. 11A illustrates the state in which the car-side compensating rope portion 32A is the detection target of the laser range scanner 46. FIG. 11B illustrates the state in which the counterweight-side compensating rope portion 32B is the detection target of the laser range scanner 46. When referring to both the car-side compensating rope portion 32A and the counterweight-side compensating rope portion 32B collectively, they will be simply called a "rope portion".

As illustrated in FIG. 11A, the overall length of the rope portion is L[m]. For the car-side compensating rope portion 32A, L is the distance from the compensating sheave 30 to the connection part with the car 26 (FIG. 11A), and for the counterweight-side compensating rope portion 32B, L is the distance from the compensating sheave 30 to the connection part with the counterweight 28 (FIG. 11B). As described above, the overall length L varies with the ascending/descending position of the car 26, and can be specified based on this ascending/descending position.

In the Figures, z[m] is the distance from the lower end of the rope portion to the laser range sensor 46 in the vertical direction of the hoistway 12. When using the laser range scanner 48 (not illustrated in FIGS. 11A and 11B, see FIG. 1), z is the distance from the lower end of the rope portion to the laser range scanner 48. That is, z[m] is the distance from the lower end of the rope portion to the scan plane of the laser range scanner used in the vertical direction of the hoistway 12. z is a constant distance for each laser range scanner used.

In FIG. 11A, the horizontal displacement of the lateral oscillations of the rope portion from the center line CL, which is illustrated with the dashed-dotted line, is the amplitude. Ameas [m] denotes the amplitude of the lateral oscillations of the rope portion (32A, 32B) on the scan plane. Aloop [m] denotes the amplitude of the lateral oscillations at the antinode.

The antinode amplitude Aloop is obtained by the processing based on the center coordinates Da and Db. Since the processing is the same for the center coordinates Da and Db, the following describes the processing based on the center coordinates Da and omits the processing based on the center coordinates Db.

The center coordinates Da detected by the center coordinate detector 6208 are output to an antinode amplitude determining unit (antinode amplitude determiner) 6210.

The antinode amplitude determining unit 6210 determines the amplitude Ameas (FIG. 11A) of the car-side compensating rope portion 32A based on the center coordinates Da output from the center coordinate detector 6208. To this end, the antinode amplitude determining unit 6210 first determines the center of lateral vibration on the scan plane of the laser range scanner 46 (one point on the center line CL in FIG. 11A).

The antinode amplitude determining unit 6210 monitors the center coordinates Da input from the center coordinate detector 6208 for each scanning of the laser range scanner 46 for a predetermined time (over a plurality of times of scanning). In one example, the predetermined time is an expected maximum cycle of the lateral vibration (for example, 10 seconds). Hereinafter, this predetermined time is called "observation time".

Figure 12A:
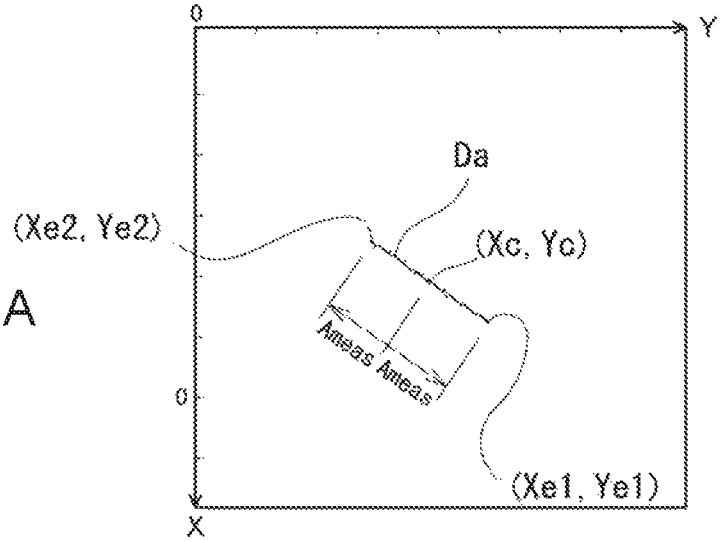
FIG. 12A illustrates a result of monitoring the center coordinates of the coordinate data group corresponding to the car-side compensating rope portion of FIG. 10B for a predetermined time (scanning results for a plurality of times during the predetermined time).

FIG. 12A illustrates the result of one such monitoring. As illustrated in FIG. 12A, the plurality of center coordinates Da in one monitoring define a line (hereinafter, this line is called a "coordinate line"). In this example, the coordinate line is linear. Depending on how the building 14 shakes, this may draw an elliptical trajectory.

The antinode amplitude determining unit 6210 extracts the coordinates (Xe1,Ye1), (Xe2,Ye2) located at both ends of the coordinate line, and calculates the midpoint (Xc,Yc) of the line segment connecting these two points. This midpoint (Xc, Yc) is set as the center (Xc, Yc) of the lateral vibration. The antinode amplitude determining unit 6210 then calculates the distance from the center (Xc, Yc) to the center coordinates Da. This distance, that is, the displacement of the rope portion from the center (Xc, Yc) is the amplitude Ameas.

Figure 12B:
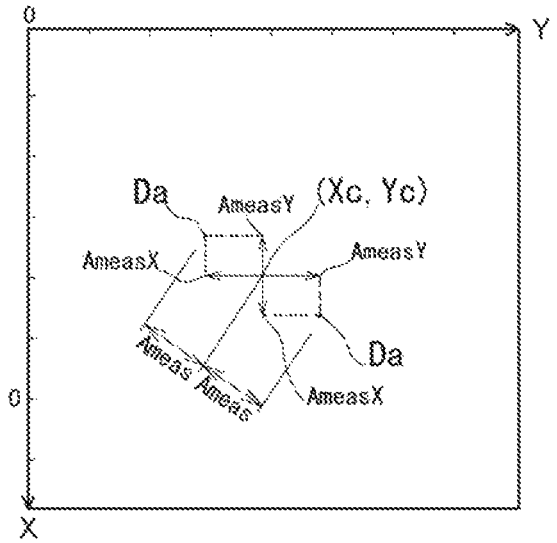
FIG. 12B illustrates the amplitude of the center coordinates that is decomposed into the X-axis direction component and the Y-axis direction component.

The antinode amplitude determining unit 6210 obtains the component AmeasX in the X-axis direction and the component AmeasY in the Y-axis direction of the amplitude Ameas with reference to the center (Xc, Yc). Positive and negative are given to AmeasX and AmeasY according to the rectangular coordinates illustrated in FIG. 12B. Specifically, AmeasX has a positive value when it is below the center (Xc, Yc) and a negative value when it is above the center (Xc, Yc). AmeasY has a positive value when it is on the right of the center (Xc, Yc) and a negative value when it is on the left of the center (Xc, Yc).

Figure 12C:
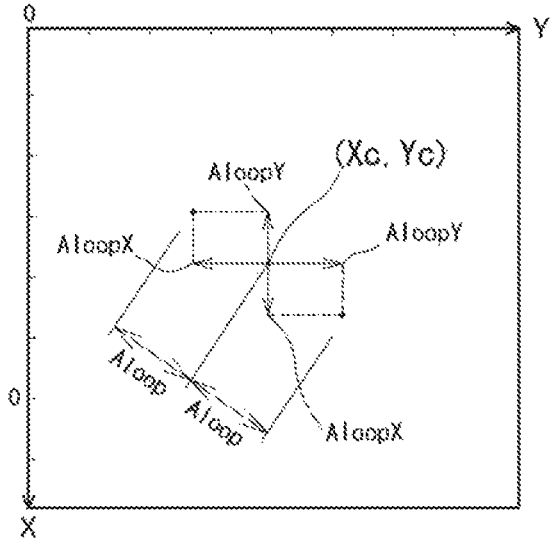
FIG. 12C illustrates the amplitude at the antinode of the lateral oscillations corresponding to the center coordinates that is decomposed into the X-axis direction component and the Y-axis direction component.

The antinode amplitude determining unit 6210 calculates the X-axis direction component AloopX and the Y-axis direction component AloopY (FIG. 12C) of the antinode amplitude Aloop from each of the obtained AmeasX and AmeasY by the following (Equation 1).

$$A\ \text{loop} = \frac{A\ meas}{\sin\left(\frac{z}{L}\pi\right)} \qquad \text{[Equation 1]}$$

(Equation 1) is based on the fact that the waveform of the lateral oscillations of the rope portion can be regarded as the shape of the primary vibration of a string, that is, the sine waveform.

After obtaining the center of lateral vibration (Xc, Yc), the antinode amplitude determining unit 6210 obtains AloopX and AloopY for each of the center coordinates Da that are sequentially (every scanning by the laser range scanner 46) output from the center coordinate detector 6208, and outputs the antinode amplitude Aloop to a waveform converter 6602 of the actuation controller 66.

As described above, the laser range scanners 46 and 48 and the rope vibration detector 62 make up a lateral vibration detection system (lateral vibration detector) 70 to detect the lateral vibration of the compensating rope group 32. Next, the following describes the lateral vibration damping control for the compensating rope group 32 based on the detection result of the lateral vibration detection system 70.

Lateral Vibration Damping Control for Compensating Ropes Control Based on the Detection Result of Laser Range Scanner 46

The following describes the processing based on the detection result of the car-side compensating rope portion 32A (center coordinates Da) by the laser range scanner 46.

Figure 13A:
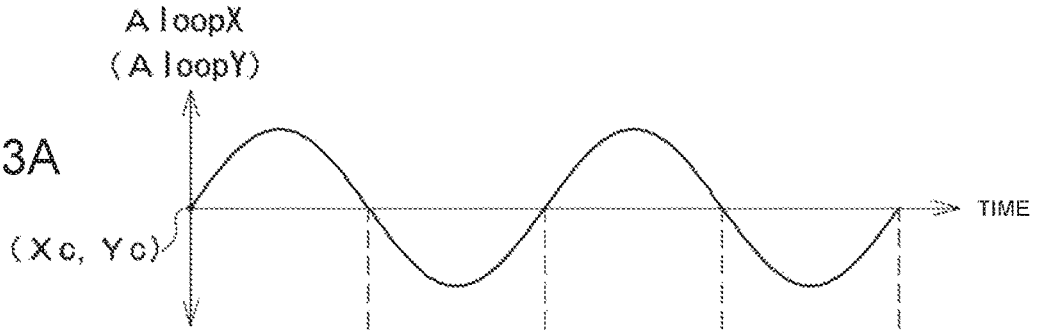
FIG. 13A illustrates the waveform of the amplitude at the antinode of lateral vibration of a car-side compensating rope portion (antinode amplitude waveform)

FIG. 13A illustrates the waveform of an antinode amplitude, in which the vertical axis represents AloopX output from the antinode amplitude determining unit 6210 to the waveform converter 6602 and the horizontal axis represents time. AloopY also has the same waveform as AloopX, although the amplitude is different. The following therefore describes AloopX as an example.

In FIG. 13A, the vertical axis represents AloopX, and a part above the time axis has a positive value, and a part below the time axis has a negative value. FIG. 13A represents the curve approximation of AloopX that is individually output from the antinode amplitude determining unit 6210.

The waveform converter 6602 converts the antinode amplitude waveform into an actuation amplitude waveform for actuation control by the actuator 118. Specifically, the waveform converter 6602 multiplies AloopX sequentially output from the antinode amplitude determining unit 6210 by a predetermined coefficient α to create an actuation amplitude waveform.

Figure 13B:
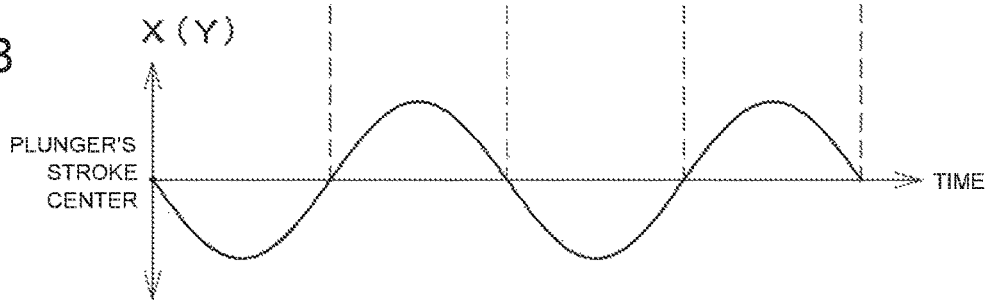
FIG. 13B illustrates an actuation amplitude waveform obtained by converting the antinode amplitude waveform into the actuation control by the actuator.

FIG. 13B illustrates the actuation amplitude waveform. In FIG. 13B, the vertical axis is the target amplitude for the rod 118*b* of the actuator 118, and the horizontal axis is the time axis. The scale of the horizontal axis in FIG. 13B is the same as the scale of FIG. 13A, and the scale of the vertical axis is different.

In this example, the coefficient α has a negative value to invert the antinode amplitude waveform with respect to the time axis and generate the actuation amplitude waveform. The value (magnitude) of the coefficient α can be obtained by experiments or the like to have an optimum value for damping the lateral oscillations of the rope portion.

Figure 14:
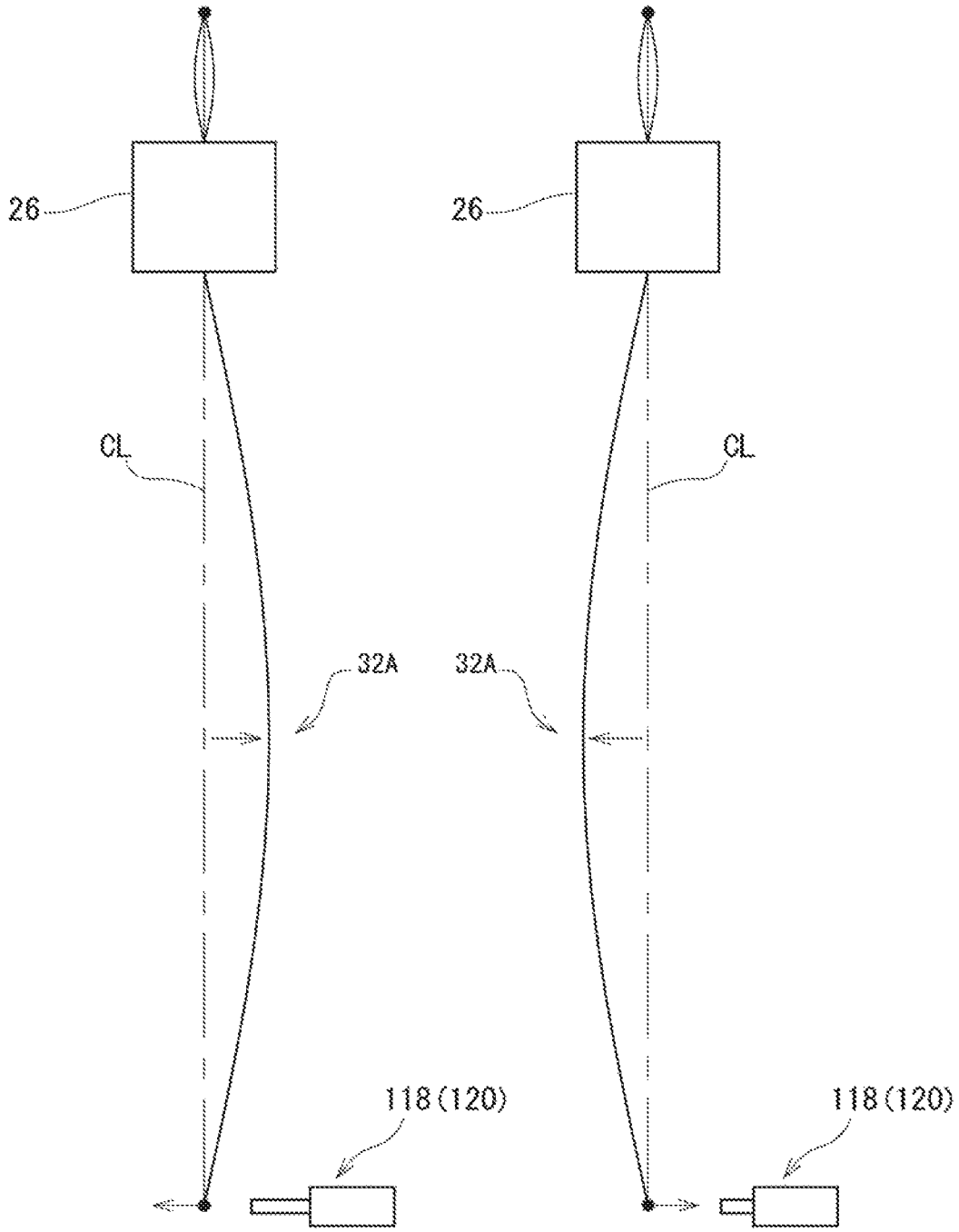
FIG. 14 explains the relationship between the amplitude (antinode amplitude) at the antinode of the lateral oscillations of the car-side compensating rope portion and the operation of the actuator.

An actuation instruction unit (actuation instructor) 6604 controls the actuation by the actuator 118 based on the actuation amplitude waveform generated by the waveform converter 6602. Referring to FIG. 14, the following describes the operation of the actuator 118 under this actuation control.

The antinode amplitude AloopX is inverted with respect to the time axis to obtain the actuation amplitude, and the displacement of the rod 118*b* by the actuator 118 is controlled based on this actuation amplitude. That is, the rod 118*b* is displaced in a direction opposite to the displacement direction of the antinode of the rope portion in the X-axis direction and according to the magnitude of the antinode amplitude AloopX. This displaces the looped position of the rope portion around the compensating sheave 30, that is, the node of the lateral oscillations at the lower end of the lateral vibration of the rope portion in the direction opposite to the antinode displacement in the X-axis direction. This enables effective damping of the X-direction component of the lateral oscillations.

The actuation by the actuator 120 is controlled based on the antinode amplitude AloopY. The actuation by the actuator 120 is controlled similar to by the actuator 118.

Specifically, the waveform converter 6602 multiplies AloopY (FIG. 13A) sequentially output from the antinode amplitude determining unit 6210 by the above-stated predetermined coefficient α to create an actuation amplitude waveform (FIG. 13B). The actuation instruction unit 6604 then controls the actuation by the actuator 120 based on the actuation waveform (actuation waveform based on the antinode amplitude AloopY) generated by the waveform converter 6602.

That is, the rod 120*b* is displaced in a direction opposite to the displacement direction of the antinode of the rope portion in the Y-axis direction and according to the magnitude of the antinode amplitude AloopY. This displaces the lower end (node of the lateral oscillations) of the rope portion in the direction opposite to the antinode displacement in the Y-axis direction. This enables effective damping of the Y-direction component of the lateral oscillations.

As described above, the actuation controller 66 controls the driving unit 116 (actuators 118 and 120) based on the antinode amplitude waveform that is the detection result of the lateral vibration detection system 70, and so functions as a driving unit controller to drive the holding unit 115 so as to damp the lateral vibration of the compensating rope group 32.

According to the embodiment having the above configuration, the actuator 118 and the actuator 120 displace the compensating sheave 30 in the direction opposite to the displacement direction of the antinode of the rope portion and according to the magnitude of the displacement of the antinode (that is, the degree of lateral vibration). This enables effective damping of the lateral vibration of the rope portion.

The above-described embodiment enables damping of the lateral vibration of the compensating ropes without detachment of the ropes, as compared with the conventional techniques. Specifically conventional techniques dampen the lateral vibration of compensating ropes by horizontally displacing the compensating ropes at a portion close to the compensating sheave with the rope locking member as described above. When the portion of the compensating ropes is to be displaced along the axial center direction of the compensating sheave, for example, the compensating ropes, which normally are orthogonal to the axial center of the compensating sheave, will be greatly inclined from this orthogonal direction, and so will be detached from the compensating sheave.

On the contrary, according to the present embodiment, the compensating sheave having the compensating ropes looped around it is displaced in the horizontal direction. When the actuator 120 displaces the compensating sheave in its axial center direction because the compensating ropes laterally vibrate largely in the Y-axis direction, for example, the distance between the compensating sheave and the car or the counterweight is considerably long, so the inclination from the orthogonal direction is small as compared with the conventional techniques. The present embodiment therefore enables damping of the lateral vibration of the compensating ropes without detachment of the ropes as compared with the conventional techniques.

Control Based on the Detection Result of Laser Range Scanner 48

The embodiment in which the counterweight 28 is located below the laser range scanner 48 is described above. In this embodiment, the car-side compensating rope portion 32A laterally vibrates more than the counterweight-side compensating rope portion 32B. The above description therefore describes the situation in which the laser range scanner 46 detects the displacement of the car-side compensating rope portion 32A, and damping control for the lateral vibration is conducted based on the detection result.

When the car 26 is located below the laser range scanner 48, the counterweight-side compensating rope portion 32B laterally vibrates more than the car-side compensating rope portion 32A. Then the displacement of the counterweight-side compensating rope portion 32B is detected using the laser range scanner 46, and damping control for the lateral vibration is conducted based on the detection result. This control is similar to for the car-side compensating rope portion 32A, and so the descriptions on the details are omitted.

When both the car 26 and the counterweight 28 are located above the laser range scanner 48, it is not always the same about whether either the counterweight-side compensating rope portion 32B or the car-side compensating rope portion 32A laterally vibrates more.

In this embodiment, the maximum amplitude for each the counterweight-side compensating rope portion 32B and the car-side compensating rope portion 32A is determined from the measurement result by the laser range scanner 48, and the actuation by the actuators 118 and 120 is controlled based on the lateral vibration of the rope portion having a larger maximum amplitude.

When both the car 26 and the counterweight 28 are located above the laser range scanner 48, the operation controller 64 selects the laser range scanner 48.

The two-dimensional position data output from the laser range scanner 48 is converted into coordinates data by the coordinate converter 6202 as described above (FIG. 9C). This coordinate data is input to the unnecessary coordinate removal unit 6204.

The unnecessary coordinate removal unit 6204 removes unnecessary coordinates based on the expected coordinates regions RA and RB stored in the expected coordinates region storage unit 6206, and outputs only the coordinates data that belongs to the expected coordinates regions RA and RB to the center coordinate detector 6208 (FIG. 10C).

The center coordinate detector 6208 detects the center coordinates Da and Db (FIG. 10C) of the coordinates data (coordinates data group) input from the unnecessary coordinate removal unit 6204 for each of the expected coordinates regions RA and RB, and outputs the detected center coordinates Da and Db to a maximum amplitude determining unit (maximum amplitude determiner) 6212.

The maximum amplitude determining unit 6212 determines the maximum amplitudes of the car-side compensating rope portion 32A and the counterweight-side compensating rope portion 32B based on the center coordinates Da and the center coordinates Db that are sequentially input from the center coordinate detector 6208 by the following procedure.

(I) The maximum amplitude determining unit 6212 monitors the center coordinates Da and the center coordinates Db sequentially input from the center coordinate detector 6208 during the above-stated observation time.

(II) From the result of the monitoring, the maximum amplitude determining unit 6212 specifies the coordinates located at both ends of the coordinate line defined with the center coordinates Da, and calculates a half of the distance between the two coordinates, that is, the amplitude Ameas of the car-side compensating rope portion 32A. Similarly, the maximum amplitude determining unit 6212 specifies the coordinates located at both ends of the coordinate line defined with the center coordinates Db, and calculates a half of the distance between the two coordinates, that is, the amplitude Ameas of the counterweight-side compensating rope portion 32B.

(III) For the amplitude Ameas of each of the car-side compensating rope portion 32A and the counterweight-side compensating rope portion 32B, the maximum amplitude determining unit 6212 calculates the antinode amplitude Aloop by (Equation 1). The determined antinode amplitude Aloop of the car-side compensating rope portion 32A is the maximum amplitude of the car-side compensating rope portion 32A, and the determined antinode amplitude Aloop of the counterweight-side compensating rope portion 32B is the maximum amplitude of the counterweight-side compensating rope portion 32B.

The maximum amplitude determining unit 6212 outputs the two maximum amplitudes determined in this way to a reference rope portion selecting unit (reference rope portion selector) 6214. The reference rope portion selecting unit 6214 compares the two maximum amplitudes input from the maximum amplitude determining unit 6212 to determine which one of the maximum amplitudes of the counterweight-side compensating rope portion 32B and the car-side compensating rope portion 32A is larger. The reference rope portion selecting unit 6214 informs the unnecessary coordinate removal unit 6204 of the determination result, that is, the rope portion having a larger maximum amplitude.

After receiving the information, the unnecessary coordinate removal unit 6204 refers to the expected coordinates region (i.e., one of the expected coordinates regions RA and RB) corresponding to the rope portion (i.e., one of the counterweight-side compensating rope portion 32B and the car-side compensating rope portion 32A) notified by the reference rope portion selecting unit 6214, removes unnecessary coordinates from the coordinates data input from the coordinate converter 6202, and outputs the resultant coordinates data to the center coordinate detector 6208.

After that, the processing up to the actuation control by the actuators 118 and 120 is the same as the above-mentioned Control based on the detection result of laser range scanner 46, and so the descriptions thereof are omitted.

Referring to FIGS. 15A-16B, the following describes modified examples of the embodiment described above. In FIGS. 15A-16B, like reference numerals designate like parts of the embodiment as stated above, and their description is given only if needed.

Modified Example 1

Figure 15A:
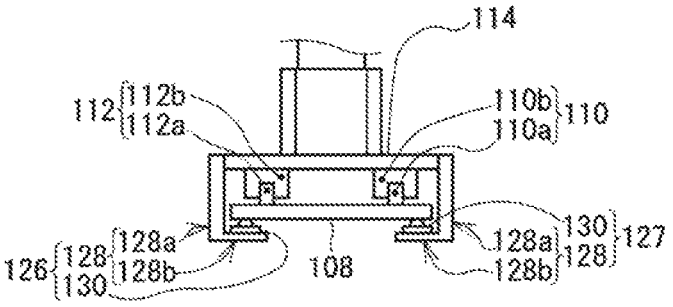
FIGS. 15A and 15B illustrate Modified Example 1 of the embodiment.
Figure 15B:
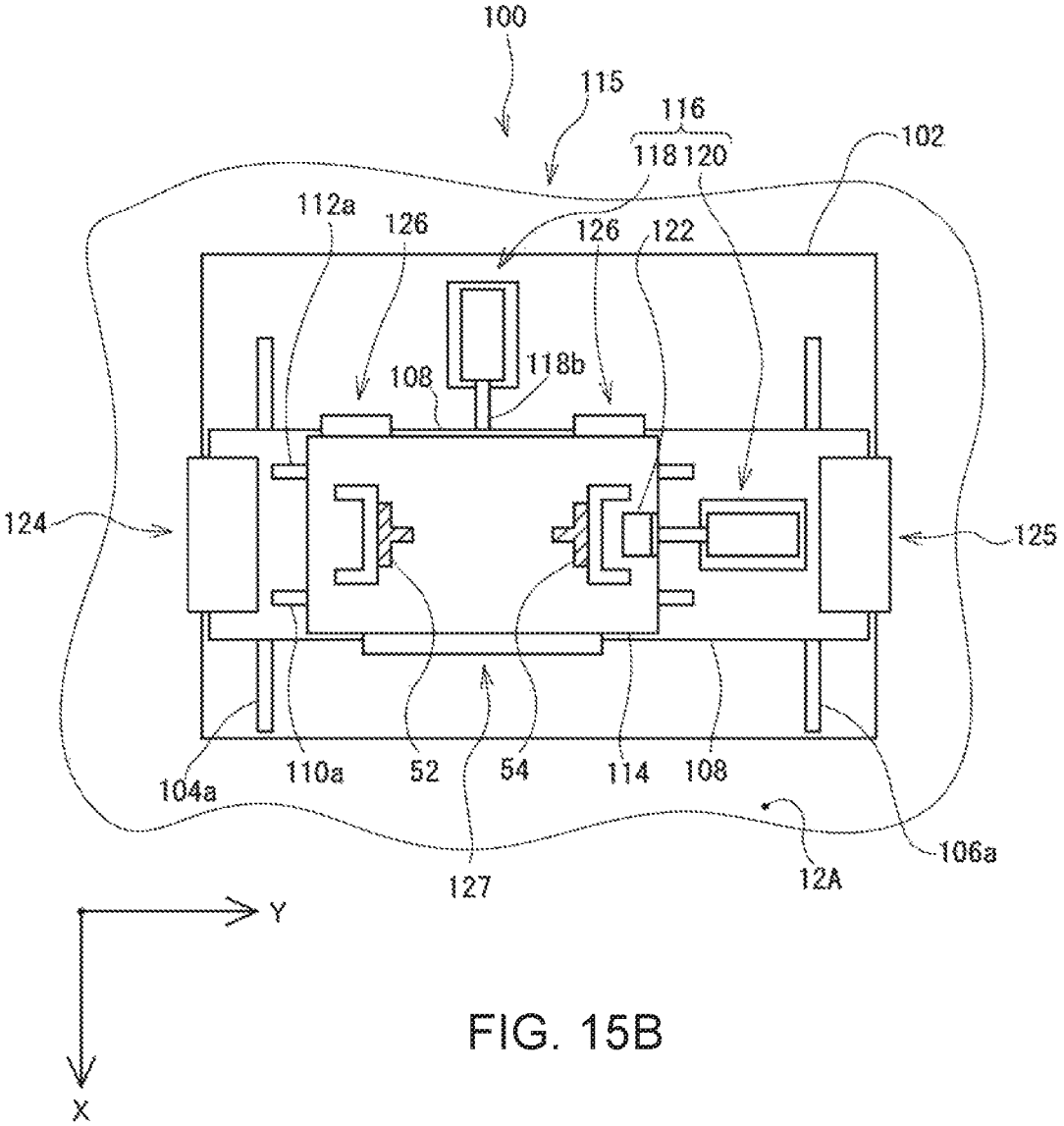

FIGS. 15A and 15B are modified examples of how to attach the stoppers 126 and 127 illustrated in FIG. 4. FIG. 15A illustrates the stoppers 126, 127 and their periphery according to the modified example, and is a left side view drawn similarly to FIG. 4. FIG. 15B is a plan view of the modified example drawn similarly to FIG. 5A.

In the example of FIG. 4, the vertical plate portions 128*a* of the stoppers 126 and 127 are fixed to the first stage 108. As illustrated in FIG. 15A, the Modified Example 1 is configured so that the stoppers 126 and 127 are each turned upside down to fix the vertical plate portion 128*a* to the second stage 114 and so that the ball roller 130 is in contact with the lower face of the first stage 108.

Modified Example 1 accordingly is configured so that, as illustrated in FIG. 15B, the rod 118*b* of the actuator 118 is directly connected to the first stage 108 without the stopper 126.

In order to keep a space for the connection, this modified example includes two stoppers 126 shorter than the stoppers 126 (FIGS. 4 and 5A) of the above embodiment on both sides of the rod 118*b*.

Modified Example 2

Figure 16A:
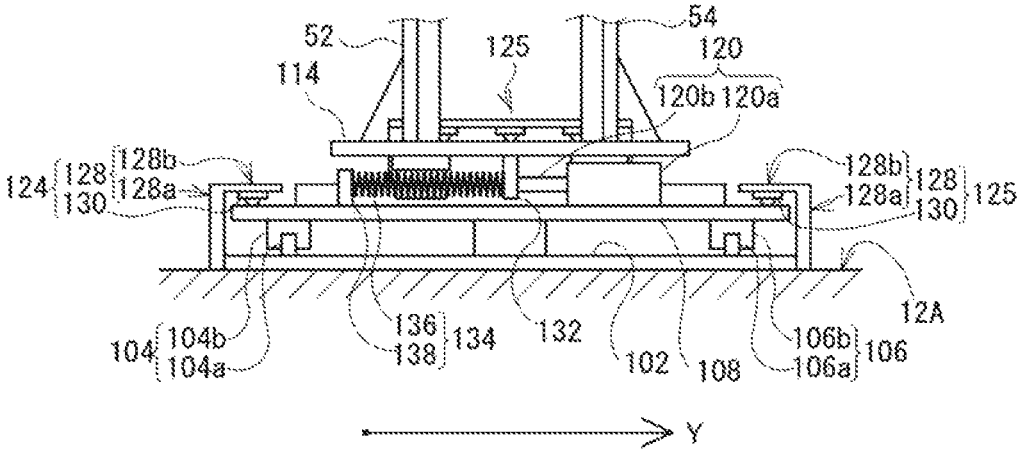
FIGS. 16A and 16B illustrate Modification Examples 2 and 3 of the embodiment, respectively.

In the above embodiment, the actuator 120 is placed laterally of the second stage 114 (FIG. 3). In Modified Example 2 illustrated in FIG. 16A, the actuator 120 is placed below the second stage 114. That is, the actuator 120 is placed at a position overlapping the second stage 114 in plan view. This makes the first stage 108, on which the actuator 120 is placed, compact, and accordingly makes the lateral-vibration damper mechanism as a whole compact. FIG. 16A omits the linear motion guide 110 and the stopper 127.

In Modified Example 2, the cylinder 120*a* of the actuator 120 is fixed to the first stage 108. The tip end of the rod 120*b* is connected to the second stage 114 via a bracket 132 fixed to the lower face of the second stage 114.

As the actuator 120 acts to move the rod 120*b* forward and backward relative to the cylinder 120*a*, the second stage 114 accordingly is driven in the Y-axis direction relative to the first stage 108.

Modified Example 2 includes a recovery device 134 configured to, when the activated actuator 120 stops, return the rod 120*b* and accordingly the guide rails 52 and 54 to their initial positions. When the rod 120*b* (guide rails 52, 54) is in the initial position, each of the compensating ropes C1 to C6 making up the compensating rope group 32 is orthogonal to the axial center of the compensating sheave 30 in front view.

If the rod 120*b* is not in the initial position when the actuation of the actuator 120 stops, each of the compensating ropes C1 to C6 making up the compensating rope group 32 is just slightly inclined from the direction orthogonal to the axial center of the compensating sheave 30 in front view. This example includes the recovery device 134 in order to reliably prevent the detachment of ropes when the normal operation is restarted in this state.

As illustrated in FIG. 16A, the recovery device 134 includes a compression coil spring 136 that is an elastic member and a bracket 138 fixed to the upper face of the first stage 108. The compression coil spring 136 has one end attached to the bracket 132 and the other end attached to the bracket 138 while having a posture with the longitudinal direction coinciding with the Y-axis direction.

The compression coil spring 136 is configured so as to have a free length when the rod 120*b* is in the initial position. When the actuation of the actuator 120 stops, the rod 120*b* can be at a position forward or backward of the initial position. In this embodiment as well, the recovery device 134 with the above structure returns the rod 120*b* to the initial position due to the restoring force of the compression coil spring 136.

The actuator 118 can also come with a recovery device similar to the recovery device 134.

Modified Example 3

In the above embodiment, the bracket 122 and the rod 120*b* of the actuator 120 are directly connected (FIG. 3, FIG. 5A). The parallelism of the rod 120*b* relative to the rails 110*a*, 112*a* of the linear motion guides 110, 112 may not be ensured in some cases due to the installation accuracy of the actuator 120, for example. This can hinder the smooth forward/backward movement of the rod 120*b*.

Figure 16B:
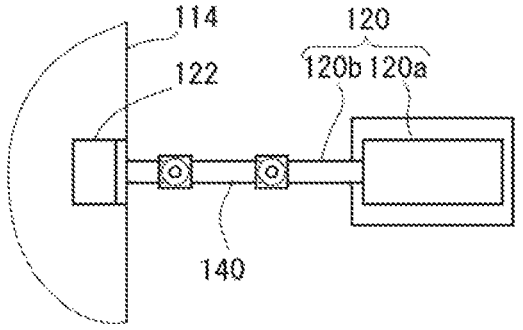

To avoid this, as illustrated in FIG. 16B, the rod 120*b* and the bracket 122 can be connected via a link 140. Similarly, the rod 118*b* of the actuator 118 and the stopper 126 also can be connected via the link 140.

That is a description of the present invention by way of the embodiment. The present invention is not limited to the above-stated embodiment, and can include the following embodiments, for example.

The above-described embodiment includes the holding unit 115 that holds the guide rails 52 and 54 to be displaceable in the horizontal direction, the guide rails guiding the compensating sheave 30 in a vertically displaceable manner. The holding unit 115 includes (a) the first stage 108 and the linear motion guides 104 and 106, and (b) the second stage 114 and the linear motion guides 110 and 112, and holds the guide rails 52 and 54 to be displaceable in the X-axis direction and the Y-axis direction.

The present invention is not limited to this structure, and in another embodiment, the holding unit can include only (a) the first stage 108 and the linear motion guides 104 and 106, or only (b) the second stage 114 and the linear motion guides 110 and 112.

When the holding unit includes only the first stage 108 and the linear motion guides 104 and 106, this enables damping of the X-axis component of the lateral vibration of the compensating rope group 32, and when the holding unit includes only the second stage 114 and the linear motion guides 110 and 112, this enables damping of the Y-axis component of the lateral vibration of the compensating rope group 32. In this way, these configurations achieve a certain effect of damping the lateral vibration.

Although the present invention has been fully described by way of examples with reference to the accompanying drawings, it is to be noted that various changes and modifications will be apparent to those skilled in the art. therefore, unless otherwise such changes and modifications depart from the scope of the present invention, they should be construed as being included therein.

What is claimed is:

1. An elevator comprising:

a compensating sheave;

a compensating rope looped around the compensating sheave to be bent back upward in a hoistway, and having a first end connected to a car and a second end connected a counterweight, the compensating rope suspended from the car and the counterweight;

a guide configured to guide the compensating sheave in a vertically displaceable manner;

a holder configured to hold the guide to be displaceable in a horizontal direction;

a driver configured to drive the holder in the horizontal direction;

a lateral vibration detector configured to detect lateral vibration of the compensating rope; and a driver controller configured to control the driver based on detected results of the lateral vibration detector and accordingly drive the holder in the horizontal direction so as to dampen lateral vibration of the compensating rope.

2. The elevator according to claim 1, wherein the holder includes: a first stage configured to be slidable in a first horizontal direction relative to a bottom of the hoistway; and a second stage configured to be slidable in a second horizontal direction intersecting the first horizontal direction relative to the first stage, the guide being fixed to the second stage, and the driver includes: a first actuator configured to drive the first stage in the first horizontal direction; and a second actuator configured to drive the second stage in the second horizontal direction.

3. The elevator according to claim 2, wherein the second actuator is located below the second stage and is disposed at the first stage.

4. The elevator according to claim 1, wherein the lateral vibration detector includes a sensor configured to measure displacement of the compensating rope in a horizontal plane at a detection position, and to detect lateral vibration of the compensating rope based on a result of the measurement by the sensor, when the car and the counterweight are located above the detection position of the sensor, the lateral vibration detector detects lateral vibration of a car-side compensating rope portion between the car and the counterweight and lateral vibration of a counterweight-side compensating rope portion between the counterweight and the compensating sheave, and specifies one of the compensating rope portions having larger lateral vibrations, and the driver controller is configured to control the driver based on a detection result of the specified compensating rope portion.

5. The elevator according to claim 1, further comprising a preventor configured to prevent upward displacement of the guide.

6. The elevator according to claim 1, further comprising a recovery device including an elastic member, and configured to return the guide with restoring force of the elastic member to an initial position where the guide is located before the driver drives the holder.

* * * * *